US008910373B2

(12) United States Patent
Yan et al.

(10) Patent No.: US 8,910,373 B2
(45) Date of Patent: Dec. 16, 2014

(54) METHOD OF MANUFACTURING AN ELECTROMAGNETIC COMPONENT

(75) Inventors: Yipeng Yan, Shanghai (CN); Robert James Bogert, Lake Worth, FL (US)

(73) Assignee: Cooper Technologies Company, Houston, TX (US)

( * ) Notice: Subject to any disclaimer, the term of this patent is extended or adjusted under 35 U.S.C. 154(b) by 1311 days.

(21) Appl. No.: 12/724,540

(22) Filed: Mar. 16, 2010

(65) Prior Publication Data

US 2010/0171579 A1 Jul. 8, 2010

Related U.S. Application Data

(62) Division of application No. 12/181,436, filed on Jul. 29, 2008, now Pat. No. 8,378,777.

(51) Int. Cl.

| | |
|---|---|
| ***H01F 7/06*** | (2006.01) |
| ***H01F 27/29*** | (2006.01) |
| ***H01F 17/00*** | (2006.01) |
| ***H01F 27/28*** | (2006.01) |
| ***H01F 41/04*** | (2006.01) |
| ***H01F 27/245*** | (2006.01) |
| *H01F 27/30* | (2006.01) |

(52) U.S. Cl.

CPC ..... *H01F 27/29* (2013.01); *H01F 17/0013* (2013.01); *H01F 27/2847* (2013.01); *H01F 41/041* (2013.01); *H01F 27/245* (2013.01); *H01F 27/2866* (2013.01); *H01F 27/292* (2013.01); *H01F 17/0033* (2013.01); *H01F 27/30* (2013.01); *H01F 2017/006* (2013.01); *H01F 2017/0066* (2013.01)

USPC ..... 29/606; 29/602.1; 29/605; 29/607; 336/178; 336/192; 336/200; 336/214; 336/215

(58) Field of Classification Search

USPC ..... 29/602.1, 604–607; 336/83, 110, 175, 336/178, 184, 192, 200, 214, 215, 223, 336/232–234

See application file for complete search history.

(56) References Cited

U.S. PATENT DOCUMENTS

| | | | |
|---|---|---|---|
| 2,391,563 | A | 12/1945 | Goldberg |
| 3,255,512 | A | 6/1966 | Lochner et al. |
| 4,072,780 | A | 2/1978 | Zillman |

(Continued)

FOREIGN PATENT DOCUMENTS

| | | |
|---|---|---|
| DE | 8132269 | 1/1986 |
| EP | 0655754 A1 | 5/1995 |

(Continued)

OTHER PUBLICATIONS

International Search Report and Written Opinion of PCT/US2011/024714; Apr. 21, 2011; 14 pages.

(Continued)

*Primary Examiner* — Paul D Kim

(74) *Attorney, Agent, or Firm* — Armstrong Teasdale LLP

(57) ABSTRACT

A method for manufacturing a low profile, magnetic component. The method includes stacking a the plurality of substantially planar and flexible magnetic powder sheets, locating a preformed multiple turn conductive winding between at least two of the plurality of substantially planar and flexible magnetic powder sheets in the stack, and pressure laminating the flexible magnetic powder sheets around the preformed multiple turn conductive winding to define a magnetic core containing the winding.

48 Claims, 14 Drawing Sheets

(56) References Cited

U.S. PATENT DOCUMENTS 4,313,152 A 1/1982 Vranken
4,322,698 A 3/1982 Takahashi et al.
4,543,553 A 9/1985 Mandai et al.
4,689,594 A 8/1987 Kawabata et al.
4,750,077 A 6/1988 Amagasa
4,758,808 A 7/1988 Sasaki et al.
4,803,425 A 2/1989 Swanberg
4,873,757 A 10/1989 Williams
5,032,815 A 7/1991 Kobayashi et al.
5,045,380 A 9/1991 Kobayashi et al.
5,250,923 A 10/1993 Ushiro et al.
5,251,108 A * 10/1993 Doshita ..... 361/792
5,257,000 A 10/1993 Billings et al.
5,300,911 A 4/1994 Walters
5,312,674 A * 5/1994 Haertling et al. ..... 428/210
5,463,717 A 10/1995 Takatori et al.
5,500,629 A 3/1996 Meyer
5,515,022 A 5/1996 Tashiro et al.
5,532,667 A 7/1996 Haertling et al.
5,572,180 A 11/1996 Huang et al.
5,610,433 A * 3/1997 Merrill et al. ..... 257/531
5,664,069 A 9/1997 Takatori et al.
5,761,791 A 6/1998 Bando
5,821,638 A 10/1998 Boys et al.
5,849,355 A 12/1998 McHenry
5,875,541 A 3/1999 Kumeji et al.
5,912,609 A 6/1999 Usui et al.
5,945,902 A 8/1999 Lipkes et al.
6,038,134 A 3/2000 Belter
6,054,914 A 4/2000 Abel et al.
6,107,907 A * 8/2000 Leigh et al. ..... 336/200
6,114,939 A 9/2000 Wittenbreder
6,169,801 B1 1/2001 Levasseur et al.
6,198,374 B1 3/2001 Abel
6,198,375 B1 3/2001 Shafer
6,204,744 B1 3/2001 Shafer et al.
6,287,931 B1 9/2001 Chen
6,293,001 B1 9/2001 Uriu et al.
6,366,192 B2 4/2002 Person et al.
6,379,579 B1 4/2002 Harada
6,392,525 B1 5/2002 Kato et al.
6,420,953 B1 7/2002 Dadafshar
6,449,829 B1 9/2002 Shafer
6,460,244 B1 10/2002 Shafer et al.
6,566,731 B2 5/2003 Ahn et al.
6,580,350 B1 * 6/2003 Kobayashi ..... 336/200
6,628,531 B2 9/2003 Dadafshar
6,631,545 B1 10/2003 Uriu et al.
6,653,196 B2 11/2003 Ahn et al.
6,658,724 B2 12/2003 Nakano et al.
6,710,692 B2 3/2004 Kato et al.
6,713,162 B2 3/2004 Takaya et al.
6,720,074 B2 4/2004 Zhang et al.
6,749,827 B2 6/2004 Smalley et al.
6,750,723 B2 6/2004 Yoshida et al.
6,791,445 B2 9/2004 Shibata et al.
6,794,052 B2 9/2004 Schultz et al.
6,797,336 B2 9/2004 Garvey et al.
6,808,642 B2 10/2004 Takaya et al.
6,817,085 B2 11/2004 Uchikoba et al.
6,835,889 B2 12/2004 Hiraoka et al.
6,859,130 B2 * 2/2005 Nakashima et al. ..... 336/200
6,864,201 B2 3/2005 Schultz et al.
6,879,238 B2 4/2005 Liu et al.
6,882,261 B2 4/2005 Moro et al.
6,885,276 B2 4/2005 Iha et al.
6,897,718 B2 5/2005 Yoshida et al.
6,908,960 B2 6/2005 Takaya et al.
6,914,510 B2 * 7/2005 Uriu et al. ..... 336/200
6,927,738 B2 8/2005 Senba et al.
6,936,233 B2 8/2005 Smalley et al.
6,946,944 B2 9/2005 Shafer et al.
6,949,237 B2 9/2005 Smalley et al.
6,952,355 B2 10/2005 Riggio et al.
6,971,391 B1 12/2005 Wang et al.
6,979,709 B2 12/2005 Smalley et al.
6,986,876 B2 1/2006 Smalley et al.
7,008,604 B2 3/2006 Smalley et al.
7,019,391 B2 3/2006 Tran
7,034,091 B2 4/2006 Schultz et al.
7,034,645 B2 4/2006 Shafer et al.
7,041,620 B2 5/2006 Smalley et al.
7,048,999 B2 5/2006 Smalley et al.
7,069,639 B2 7/2006 Choi et al.
7,071,406 B2 7/2006 Smalley et al.
7,078,999 B2 7/2006 Uriu et al.
7,081,803 B2 7/2006 Takaya et al.
7,087,207 B2 8/2006 Smalley et al.
7,091,412 B2 8/2006 Wang et al.
7,091,575 B2 8/2006 Ahn et al.
7,105,596 B2 9/2006 Smalley et al.
7,108,841 B2 9/2006 Smalley et al.
7,127,294 B1 10/2006 Wang et al.
7,142,066 B1 11/2006 Hannah et al.
7,162,302 B2 1/2007 Wang et al.
7,187,263 B2 3/2007 Vinciarelli
7,205,069 B2 4/2007 Smalley et al.
7,213,915 B2 5/2007 Tsutsumi et al.
7,221,249 B2 5/2007 Shafer et al.
7,262,482 B2 8/2007 Ahn et al.
7,263,761 B1 9/2007 Shafer et al.
7,294,366 B2 11/2007 Renn et al.
7,319,599 B2 1/2008 Hirano et al.
7,330,369 B2 2/2008 Tran
7,339,451 B2 3/2008 Liu et al.
7,345,562 B2 3/2008 Shafer et al.
7,354,563 B2 4/2008 Smalley et al.
7,375,417 B2 5/2008 Tran
7,380,328 B2 6/2008 Ahn et al.
7,390,477 B2 6/2008 Smalley et al.
7,390,767 B2 6/2008 Smalley et al.
7,393,699 B2 7/2008 Tran
7,400,512 B2 7/2008 Hirano et al.
7,419,624 B1 9/2008 Smalley et al.
7,419,651 B2 9/2008 Smalley et al.
7,442,665 B2 10/2008 Schultz et al.
7,445,852 B2 11/2008 Maruko et al.
7,481,989 B2 1/2009 Smalley et al.
7,485,366 B2 2/2009 Ma et al.
7,489,537 B2 2/2009 Tran
7,567,163 B2 7/2009 Dadafshar et al.
7,791,445 B2 9/2010 Manoukian et al.
8,188,933 B2 * 5/2012 Nakamura et al. ..... 343/788
2001/0016977 A1 8/2001 Moro et al.
2001/0043135 A1 11/2001 Yamada et al.
2002/0009577 A1 1/2002 Takaya et al.
2002/0067234 A1 6/2002 Kung
2002/0121957 A1 9/2002 Takashima et al.
2003/0029830 A1 2/2003 Takaya et al.
2003/0184423 A1 10/2003 Holdahl et al.
2004/0017276 A1 1/2004 Chen et al.
2004/0174239 A1 9/2004 Shibata et al.
2004/0189430 A1 9/2004 Matsutani et al.
2004/0209120 A1 10/2004 Inoue et al.
2004/0210289 A1 10/2004 Wang et al.
2005/0012581 A1 1/2005 Ono et al.
2005/0151614 A1 7/2005 Dadafshar
2005/0174207 A1 8/2005 Young et al.
2005/0184848 A1 8/2005 Yoshida et al.
2005/0188529 A1 9/2005 Uriu et al.
2006/0001517 A1 1/2006 Cheng
2006/0038651 A1 2/2006 Mizushima et al.
2006/0049906 A1 3/2006 Liu et al.
2006/0145800 A1 7/2006 Dadafshar et al.
2006/0145804 A1 7/2006 Matsutani et al.
2006/0186975 A1 8/2006 Wang
2006/0186978 A1 8/2006 Kawarai
2007/0030108 A1 2/2007 Ishimoto et al.
2007/0057755 A1 3/2007 Suzuki et al.
2007/0163110 A1 7/2007 Sutardja
2007/0252669 A1 11/2007 Hansen et al.
2008/0001702 A1 1/2008 Brunner
2008/0012679 A1 1/2008 Okabe et al.
2008/0061917 A1 3/2008 Manoukian et al.

(56) References Cited

U.S. PATENT DOCUMENTS

| | | | |
|---|---|---|---|
| 2008/0110014 | A1 | 5/2008 | Shafer et al. |
| 2008/0278275 | A1 | 11/2008 | Fouquet et al. |
| 2008/0310051 | A1 | 12/2008 | Yan et al. |
| 2009/0058588 | A1 | 3/2009 | Suzuki et al. |
| 2009/0179723 | A1 | 7/2009 | Ikriannikov et al. |
| 2009/0302512 | A1 | 12/2009 | Gablenz et al. |
| 2010/0007451 | A1 | 1/2010 | Yan et al. |
| 2010/0007453 | A1 | 1/2010 | Yan et al. |
| 2010/0007457 | A1 | 1/2010 | Yan et al. |
| 2010/0013587 | A1 | 1/2010 | Yan et al. |
| 2010/0026443 | A1 | 2/2010 | Yan et al. |
| 2010/0039200 | A1 | 2/2010 | Yan |
| 2010/0085139 | A1 | 4/2010 | Yan et al. |
| 2010/0171581 | A1 | 7/2010 | Manoukian et al. |
| 2010/0259351 | A1 | 10/2010 | Bogert et al. |
| 2010/0259352 | A1 | 10/2010 | Yan et al. |
| 2010/0277267 | A1 | 11/2010 | Bogert et al. |

FOREIGN PATENT DOCUMENTS

| | | | |
|---|---|---|---|
| EP | 0785557 | A1 | 7/1997 |
| EP | 1150312 | A2 | 10/2001 |
| EP | 1288975 | A2 | 3/2003 |
| EP | 1486991 | A1 | 12/2004 |
| EP | 1526556 | A1 | 4/2005 |
| EP | 1564761 | A1 | 8/2005 |
| EP | 1833063 | A1 | 9/2007 |
| FR | 2556493 | A1 | 6/1985 |
| GB | 2044550 | A | 10/1980 |
| JP | 6423121 | | 2/1989 |
| JP | 1266705 | | 10/1989 |
| JP | 03241711 | | 10/1991 |
| JP | 05291046 | | 5/1993 |
| JP | 06216538 | | 8/1994 |
| JP | 07272932 | | 10/1995 |
| JP | 2700713 | | 1/1998 |
| JP | 10106839 | | 4/1998 |
| JP | 2000182872 | | 6/2000 |
| JP | 3108931 | | 11/2000 |
| JP | 3160685 | | 4/2001 |
| JP | 2002043143 | | 2/2002 |
| JP | 2002280745 | | 9/2002 |
| JP | 2002313632 | | 10/2002 |
| JP | 2004200468 | | 7/2004 |
| JP | 2005129968 | | 5/2005 |
| JP | 2007227914 | | 9/2007 |
| JP | 2008078178 | | 4/2008 |
| KR | 20010014533 | | 2/2001 |
| KR | 20020071285 | | 9/2002 |
| KR | 20030081738 | | 10/2003 |
| WO | 9205568 | | 4/1992 |
| WO | 9704469 | | 2/1997 |
| WO | 0191141 | A1 | 11/2001 |
| WO | 2005008692 | A2 | 1/2005 |
| WO | 2005024862 | A1 | 3/2005 |
| WO | 2006063081 | A2 | 6/2006 |
| WO | 2008008538 | A2 | 1/2008 |
| WO | 2008152493 | A2 | 12/2008 |
| WO | 2009113775 | A2 | 9/2009 |

OTHER PUBLICATIONS

International Preliminary Report on Patentability of PCT/US2009/057471; Apr. 21, 2011; 6 pages.
International Search Report and Written Opinion of PCT/US2010/032803; Aug. 23, 2010; 16 pages.
International Search Report and Written Opinion of PCT/US2010/032798; Aug. 20, 2010; 15 pages.
International Search Report and Written Opinion of PCT/US2010/031886; Aug. 18, 2010; 14 pages.
International Search Report and Written Opinion of PCT/US2010/032517; Aug. 12, 2010; 16 pages.
International Search Report and Written Opinion of PCT/US2010/032414; Aug. 11, 2010; 15 pages.
International Search Report and Written Opinion of PCT/US2010/032407; Aug. 2, 2010; 19 pages.
International Search Report and Written Opinion of PCT/US2010/032992; Jul. 28, 2010; 15 pages.
International Search Report and Written Opinion of PCT/US2010/032540; Jul. 27, 2010; 20 pages.
International Search Report and Written Opinion of PCT/US2010/033006; Jul. 15, 2010; 18 pages.
International Search Report and Written Opinion of PCT/US2010/032787; Jul. 14, 2010; 20 pages.
VISA—Literatur; http://130.149.194.207/visa-projekt/literatur.htm; Federal Ministry of Education and Research; Jan. 23, 2009. 11 pages.
VISA—Overview; http://130.149.194.207/visa-projekt/index.htm; Federal Ministry of Education and Research; Jan. 23, 2009. 1 page.
Waffenschmidt, E.; VISA-Ferrite Polymer Compounds; http://130.149.194.207/visa-projekt/technology/ferrite_polymers.htm; Federal Ministry of Education and Research; Jan. 21, 2009. 2 pages.
Waffenschmidt, E.; VISA—The Concept; http://130.149.194.207/visa-projekt/technology/concept.htm; Federal Ministry of Education and Research; Jan. 21, 2009. 2 pages.
VISA—Technology; http://130.149.194.207/visa-projekt/technology/technology.htm; Federal Ministry of Education and Research; Jan. 21, 2009. 1 page.
Heinrichs, F., et al.; Elements to Achieve Automotive Power; www.powersystemsdesign.com; Oct. 2004; pp. 37-40; Power Systems Design Europe.
Yoshida, S., et al.; Permeability and Electromagnetic-Interference Characteristics for Fe—Si—Al Alloy Flakes—Polymer Composite; Journal of Applied Physics; Apr. 15, 1999; pp. 4636-4638; vol. 85, No. 8; American Institute of Physics.
Ferrite Polymer Composite (FPC) Film; http:// www.epcos.com/inf/80/ap/e0001000.htm; 1999 EPCOS; 8 pages.
Kelley, A., et al; Plastic-Iron-Powder Distributed-Air-Gap Magnetic Material; Power Electronics Specialists Conference; 1990; PESC '90 Record; 21st Annual IEEE; Jun. 11-14, 1999; pp. 25-34; San Antonio, TX.
International Search Report and Written Opinion of PCT/US2009/057471; Dec. 14, 2009; 14 pages.
International Search Report and Written Opinion of PCT/US2009/051005; Sep. 23, 2009; 15 pages.
Kim, S. et al; Electromagnetic Shielding Properties of Soft Magnetic Powder-Polymer Composite Films for the Application to Suppress Noise in the Radio Frequency Range; www.sciencedirect.com; Journal of Magnetism and Magnetic Materials 316 (2007) 472-474.

* cited by examiner

METHOD OF MANUFACTURING AN ELECTROMAGNETIC COMPONENT

CROSS REFERENCE TO RELATED APPLICATIONS

The present application is a divisional application of U.S. patent application Ser. No. 12/181,436 filed Jul. 29, 2008 and now issued U.S. Pat. No. 8,378,777, the entire disclosure of which is hereby incorporated by reference in its entirety.

TECHNICAL FIELD

The invention relates generally to electronic components and methods of manufacturing these components and, more particularly, to inductors, transformers, and the methods of manufacturing them.

BACKGROUND

Typical inductors may include shaped cores, including a shield core and drum core, U core and I core, E core and I core, and other matching shapes. The inductors typically have a conductive wire wrapped around the core or a clip. The wrapped wire is commonly referred to as a coil and is wound on the drum core or other bobbin core directly. Each end of the coil may be referred to as a lead and is used for coupling the inductor to an electrical circuit. Discrete cores may be bound together through an adhesive.

With advancements in electronic packaging, the trend has been to manufacture power inductors having miniature structures. Thus, the core structure must have lower and lower profiles so that they may accommodate the modern electronic devices, some of which may be slim or have a very thin profile. Manufacturing inductors having the low profile has caused manufactures to encounter many difficulties, thereby making the manufacturing process expensive.

For example, as the components become smaller and smaller, difficulty has arisen due to the nature of the components being hand wound. These hand wound components provide for inconsistencies in the product themselves. Another encountered difficulty includes the shape cores being very fragile and prone to core cracking throughout the manufacturing process. An additional difficulty is that the inductance is not very consistent due to the gap deviation between the two discrete cores, including but not limited to drum cores and shielded cores and U cores and I cores, during assembly. A further difficulty is that the DC resistance ("DCR") is not consistent due to uneven winding and tension during the winding process. These difficulties represent examples of just a few of the many difficulties encountered while attempting to manufacture inductors having a miniature structure.

Manufacturing processes for inductors, like other components, have been scrutinized as a way to reduce costs in the highly competitive electronics manufacturing business. Reduction of manufacturing costs is particularly desirable when the components being manufactured are low cost, high volume components. In a high volume component, any reduction in manufacturing cost is, of course, significant. It may be possible that one material used in manufacturing may have a higher cost than another material, but the overall manufacturing cost may be less by using the more costly material because the reliability and consistency of the product in the manufacturing process is greater than the reliability and consistency of the same product manufactured with the less costly material. Thus, a greater number of actual manufactured products may be sold, rather than being discarded. Additionally, it also is possible that one material used in manufacturing a component may have a higher cost than another material, but the labor savings more than compensates for the increase in material costs. These examples are just a few of the many ways for reducing manufacturing costs.

It has become desirable to provide a magnetic component of increased efficiency and improved manufacturability without increasing the size of the components and occupying an undue amount of space, especially when used on circuit board applications. It also has become desirable to lessen the amount of manual manufacturing steps involved and automating more of the steps in the manufacturing process so that more consistent and reliable products may be produced.

SUMMARY

A magnetic component and a method for manufacturing a low profile, magnetic component are disclosed herein. The magnetic components include, but are not limited to, inductors and transformers. The magnetic components include at least one sheet and at least a portion of a winding coupled to the at least one sheet. The at least one sheet is laminated to at least a portion of the winding. The winding is oriented in a manner such that a magnetic field is generated in a desired direction when current flows through the winding. The winding may be made of a clip, a preformed coil, a stamped conductive foil, an etched trace using chemical or laser etching processes, or a combination of these exemplary windings. Additionally, terminations may be formed at the bottom of the magnetic component or formed on a substrate to which the magnetic component mounts to.

According to some embodiments, a plurality of sheets are layered on top of one another, where at least a portion of the winding is configured within the plurality of sheets. The plurality of sheets are laminated to one another to form the magnetic component. According to some embodiments, the entire winding is configured within the plurality of sheets, which may include the upper surface of the top sheet and/or the lower surface of the bottom sheet. According to alternative embodiments, a portion of the winding may be positioned on a substrate, such as, for example, a printed circuit board. Thus, the winding is not complete until the magnetic component is mounted to the substrate. According to another alternative embodiment, the sheet may be rolled around a winding and then laminated to form the magnetic component. In some embodiments, a portion of the winding forms the terminations.

According to another exemplary embodiment, the winding may be oriented in a manner such that a magnetic field is generated in a vertical orientation. In another exemplary embodiment, the winding may be oriented in a manner such that a magnetic field is generated in a horizontal direction. In a further exemplary embodiment, the winding may be oriented in a manner such that more than one magnetic field is generated in the same direction, each parallel to one another. In another exemplary embodiment, the winding may be oriented in a manner such that more than one magnetic field is generated in different directions, one oriented in a generally perpendicular direction with respect to another. Moreover, a plurality of winding may be formed within the magnetic component.

These and other aspects, objects, features, and advantages of the invention will become apparent to a person having ordinary skill in the art upon consideration of the following detailed description of illustrated exemplary embodiments, which include the best mode of carrying out the invention as presently perceived.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF EXEMPLARY EMBODIMENTS

Referring to FIGS. 1-14, several views of various illustrative, exemplary embodiments of a magnetic component or device are shown. In an exemplary embodiment the device is an inductor, although it is appreciated that the benefits of the invention described below may accrue to other types of devices. While the materials and techniques described below are believed to be particularly advantageous for the manufacture of low profile inductors, it is recognized that the inductor is but one type of electrical component in which the benefits of the invention may be appreciated. Thus, the description set forth is for illustrative purposes only, and it is contemplated that benefits of the invention accrue to other sizes and types of inductors, as well as other electronic components, including but not limited to transformers. Therefore, practice of the inventive concepts herein is not limited solely to the exemplary embodiments described herein and illustrated in the Figures. Additionally, it is understood that the Figures are not to scale, and that the thickness and other sizes of the various components have been exaggerated for the purpose of clarity.

Figure 1A:
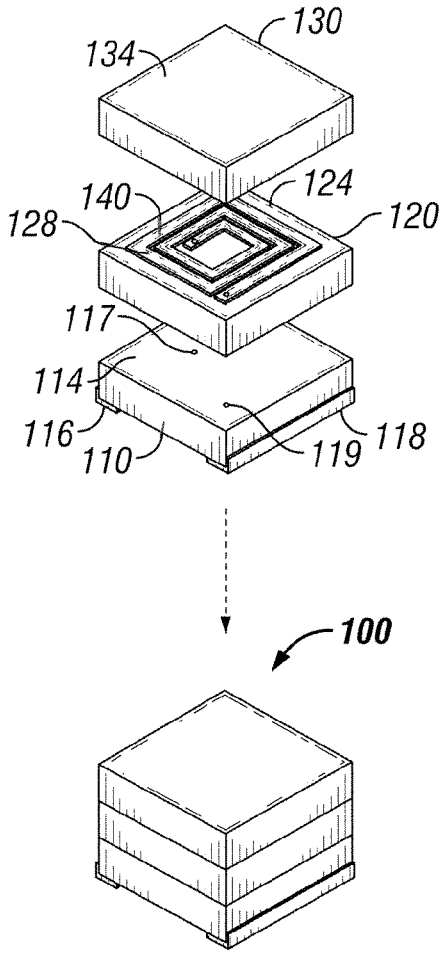
FIG. 1*a* illustrates a perspective view and an exploded view of the top side of a miniature power inductor having a winding in a first winding configuration, at least one magnetic powder sheet and a vertically oriented core area in accordance with an exemplary embodiment.
Figure 1B:
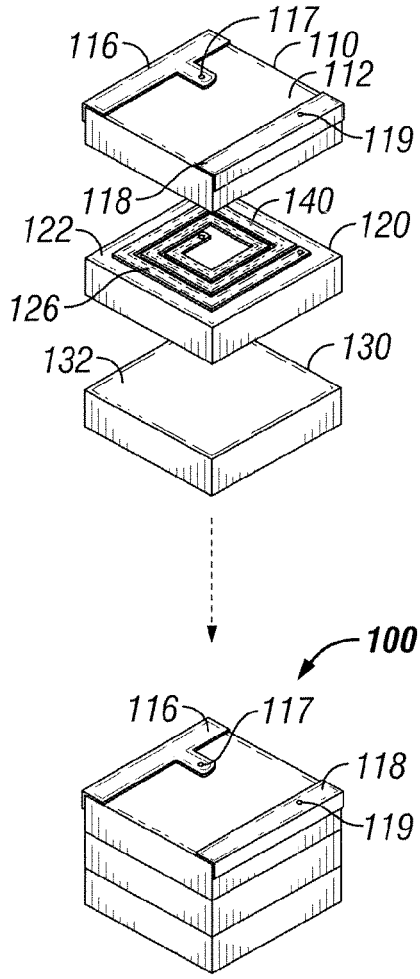
FIG. 1*b* illustrates a perspective view and an exploded view of the bottom side of the miniature power inductor as depicted in FIG. 1*a* in accordance with an exemplary embodiment.
Figure 1C:
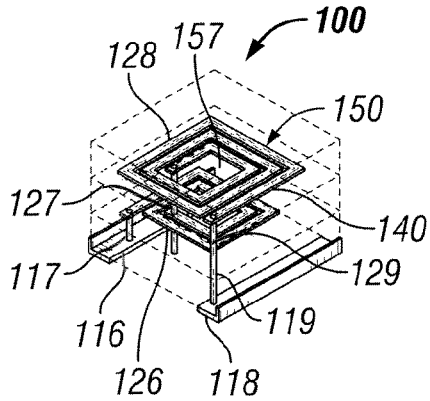
FIG. 1*c* illustrates a perspective view of the first winding configuration of the miniature power inductor as depicted in FIG. 1*a* and FIG. 1*b* in accordance with an exemplary embodiment.

Referring to FIGS. 1*a*-1*c*, several views of a first illustrative embodiment of a magnetic component or device 100 are shown. FIG. 1*a* illustrates a perspective view and an exploded view of the top side of a miniature power inductor having a winding in a first winding configuration, at least one magnetic powder sheet and a vertically oriented core area in accordance with an exemplary embodiment. FIG. 1*b* illustrates a perspective view and an exploded view of the bottom side of the miniature power inductor as depicted in FIG. 1*a* in accordance with an exemplary embodiment. FIG. 1*c* illustrates a perspective view of the first winding configuration of the miniature power inductor as depicted in FIG. 1*a* and FIG. 1*b* in accordance with an exemplary embodiment.

According to this embodiment, the miniature power inductor 100 comprises at least one magnetic powder sheet 110, 120, 130 and a winding 140 coupled to the at least one magnetic powder sheet 110, 120, 130 in a first winding configuration 150. As seen in this embodiment, the miniature power inductor 100 comprises a first magnetic powder sheet 110 having a lower surface 112 and an upper surface 114, a second magnetic powder sheet 120 having a lower surface 122 and an upper surface 124, and a third magnetic powder sheet 130 having a lower surface 132 and an upper surface 134. In an exemplary embodiment, each magnetic powder sheet can be a magnetic powder sheet manufactured by Chang Sung Incorporated in Incheon, Korea and sold under product number 20u-eff Flexible Magnetic Sheet. Also, these magnetic powder sheets have grains which are dominantly oriented in a particular direction. Thus, a higher inductance may be achieved when the magnetic field is created in the direction of the dominant grain orientation. Although this embodiment depicts three magnetic powder sheets, the number of magnetic sheets may be increased or reduced so as to increase or decrease the number of turns in the winding or to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

The first magnetic powder sheet 110 also includes a first terminal 116 and a second terminal 118 coupled to opposing longitudinal edges of the lower surface 112 of the first magnetic powder sheet 110. These terminals 116, 118 may be used to couple the miniature power inductor 100 to an electrical circuit, which may be on a printed circuit board (not shown), for example. Each of the terminals 116, 118 also comprises a via 117, 119 for coupling the terminals 116, 118 to one or more winding layers, which will be further discussed below. The vias 117, 119 are conductive connectors which proceed from the terminals 116, 118 on the lower surface 112 to the upper surface 114 of the first magnetic powder sheet 110. The vias may be formed by drilling a hole through the magnetic powder sheets and plating the inner circumference of the drilled hole with conductive material. Alternatively, a conductive pin may be placed into the drilled holes to establish the conductive connections in the vias. Although the vias 117, 119 are shown to be cylindrical in shape, the vias may be a different geometric shape, for example, rectangular, without departing from the scope and spirit of the exemplary embodiment. In one exemplary embodiment, the entire inductor can be formed and pressed before drilling the vias. Although the terminals are shown to be coupled to opposing longitudinal edges, the terminals may be coupled at alternative locations on the lower surface of the first magnetic powder sheet without departing from the scope and spirit of the exemplary embodiment. Also, although each terminal is shown to have one via, additional vias may be formed in each of the terminals so as to position the one or more winding layers in parallel, rather than in series, depending upon the application, without departing from the scope and spirit of the exemplary embodiment.

The second magnetic powder sheet 120 has a first winding layer 126 coupled to the lower surface 122 and a second winding layer 128 coupled to the upper surface 124 of the second magnetic powder sheet 120. Both winding layers 126, 128 combine to form the winding 140. The first winding layer 126 is coupled to the terminal 116 through the via 117. The second winding layer 128 is coupled to the first winding layer 126 through via 127, which is formed in the second magnetic powder sheet 120. Via 127 proceeds from the lower surface 122 to the upper surface 124 of the second magnetic powder sheet 120. The second winding layer 128 is coupled to the second terminal 118 through vias 129, 119. Via 129 proceeds from the upper surface 124 to the lower surface 122 of the second magnetic powder sheet 120. Although two winding layers are shown to be coupled to the second magnetic powder sheet in this embodiment, there may be one winding layer coupled to the second magnetic powder sheet without departing from the scope and spirit of the exemplary embodiment.

The winding layers 126, 128 are formed from a conductive copper layer which is coupled to the second magnetic powder sheet 120. This conductive copper layer may include, but is not limited to, a stamped copper foil, an etched copper trace, or a preformed coil without departing from the scope and spirit of the exemplary embodiment. The etched copper trace may be formed, but is not limited to, chemical processes, photolithography techniques, or by laser etching techniques. As shown in this embodiment, the winding layer is a rectangular-shaped spiral pattern. However, other patterns may be used to form the winding without departing from the scope and spirit of the exemplary embodiment. Although copper is used as the conductive material, other conductive materials may be used without departing from the scope and spirit of the exemplary embodiment. The terminals 116, 118 may also be formed using a stamped copper foil, an etched copper trace, or by any other suitable method.

The third magnetic powder sheet 130, according to this embodiment, is placed on the upper surface 124 of the second magnetic powder sheet 120 so that the second winding layer 128 may be insulated and also so that the core area may be increased for handling higher current flow.

Although the third magnetic powder sheet is not shown to have a winding layer, a winding layer may be added to the lower surface of the third magnetic layer in lieu of the winding layer on the upper surface of the second magnetic powder sheet without departing from the scope and spirit of the exemplary embodiment. Additionally, although the third magnetic powder sheet is not shown to have a winding layer, a winding layer may be added to the upper surface of the third magnetic layer without departing from the scope and spirit of the exemplary embodiment.

Upon forming each of the magnetic powder sheets 110, 120, 130 with the winding layers 126, 128 and/or terminals 116, 118, the sheets 110, 120, 130 are pressed with high pressure, for example, hydraulic pressure, and laminated together to form the miniature power inductor 100. After the sheets 110, 120, 130 have been pressed together, the vias are formed, as previously discussed. According to this embodiment, the physical gap between the winding and the core, which is typically found in conventional inductors, is removed. The elimination of this physical gap tends to minimize the audible noise from the vibration of the winding.

The miniature power inductor 100 is depicted as a cube shape. However, other geometrical shapes, including but not limited to rectangular, circular, or elliptical shapes, may be used without departing from the scope and spirit of the exemplary embodiment.

The winding 140 includes a first winding layer 126 and a second winding layer 128 and forms a first winding configuration 150 having a vertically oriented core 157. The first winding configuration 150 starts at the first terminal 116, then proceeds to the first winding layer 126, then proceeds to the second winding layer 128, and then proceeds to the second terminal 118. Thus, in this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

Figure 2A:
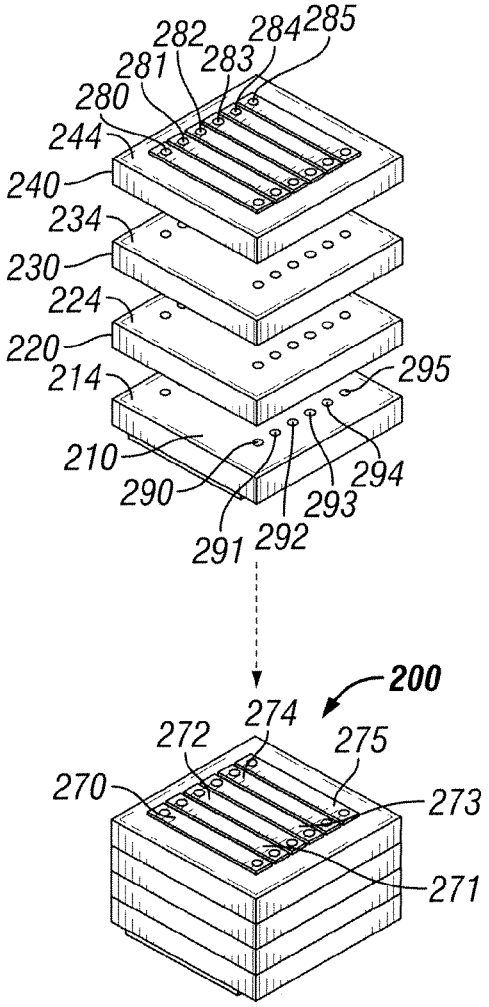
FIG. 2*a* illustrates a perspective view and an exploded view of the top side of a miniature power inductor having a winding in a second winding configuration, at least one magnetic powder sheet and a horizontally oriented core area in accordance with an exemplary embodiment.
Figure 2B:
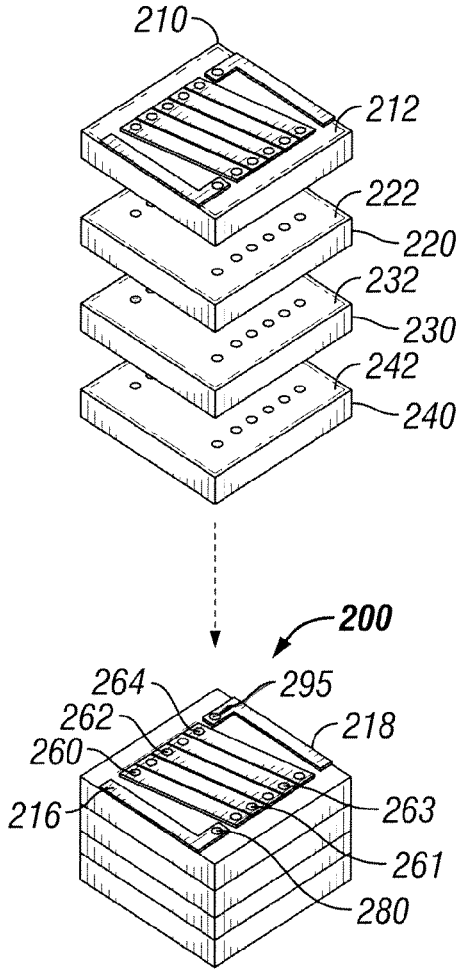
FIG. 2*b* illustrates a perspective view and an exploded view of the bottom side of the miniature power inductor as depicted in FIG. 2*a* in accordance with an exemplary embodiment.
Figure 2C:
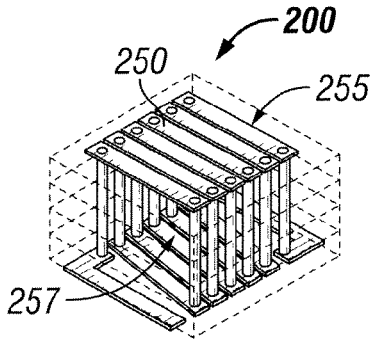
FIG. 2*c* illustrates a perspective view of the second winding configuration of the miniature power inductor as depicted in FIG. 2*a* and FIG. 2*b* in accordance with an exemplary embodiment.

Referring to FIGS. 2*a*-2*c*, several views of a second illustrative embodiment of a magnetic component or device 200 are shown. FIG. 2*a* illustrates a perspective view and an exploded view of the top side of a miniature power inductor having a winding in a second winding configuration, at least one magnetic powder sheet and a horizontally oriented core area in accordance with an exemplary embodiment. FIG. 2*b* illustrates a perspective view and an exploded view of the bottom side of the miniature power inductor as depicted in FIG. 2*a* in accordance with an exemplary embodiment. FIG. 2*c* illustrates a perspective view of the second winding configuration of the miniature power inductor as depicted in FIG. 2*a* and FIG. 2*b* in accordance with an exemplary embodiment.

According to this embodiment, the miniature power inductor 200 comprises at least one magnetic powder sheet 210, 220, 230, 240 and a winding 250 coupled to the at least one magnetic powder sheet 210, 220, 230, 240 in a second winding configuration 255. As seen in this embodiment, the miniature power inductor 200 comprises a first magnetic powder sheet 210 having a lower surface 212 and an upper surface 214, a second magnetic powder sheet 220 having a lower surface 222 and an upper surface 224, a third magnetic powder sheet 230 having a lower surface 232 and an upper surface 234, and a fourth magnetic powder sheet 240 having a lower surface 242 and an upper surface 244. As previously mentioned, the exemplary magnetic powder sheets can be magnetic powder sheets manufactured by Chang Sung Incorporated in Incheon, Korea and sold under product number 20u-eff Flexible Magnetic Sheet, and have the same characteristics as described above. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

The first magnetic powder sheet 210 also includes a first terminal 216 and a second terminal 218 coupled to opposing longitudinal sides of the lower surface 212 of the first magnetic powder sheet 210. These terminals 216, 218 may be used to couple the miniature power inductor 200 to an electrical circuit, which may be on a printed circuit board (not shown), for example. The first magnetic powder sheet 210 also includes a first bottom winding layer portion 260, a second bottom winding layer portion 261, a third bottom winding layer portion 262, a fourth bottom winding layer portion 263, and a fifth bottom winding layer portion 264 that are all positioned in substantially the same direction as the terminals 216, 218 and positioned between the terminals 216, 218 in a non-contacting relationship to one another. These bottom winding layer portions 260, 261, 262, 263, 264 are also located on the lower surface 212 of the first magnetic powder sheet 210.

Each of the terminals 216, 218 comprises a via 280, 295, respectively, for coupling the terminals 216, 218 to one or more winding layers. Additionally, each of the bottom winding layer portions 260, 261, 262, 263, 264 comprise two vias for coupling the bottom winding layer portions 260, 261, 262, 263, 264 to a respective top winding layer portions 270, 271, 272, 273, 274, 275, which is described in detail below. As listed, there is one additional top winding layer portion than bottom winding layer portion.

The second magnetic powder sheet 220 and the third magnetic powder sheet 230 comprise a plurality of vias 280, 281, 282, 283, 284, 285, 290, 291, 292, 293, 294, 295 for coupling the terminals 216, 218, the bottom winding layer portions 260, 261, 262, 263, 264, and top winding layer portions 270, 271, 272, 273, 274, 275 to one another.

The fourth magnetic powder sheet 240 also includes a first top winding layer portion 270, a second top winding layer portion 271, a third top winding layer portion 272, a fourth top winding layer portion 273, a fifth top winding layer portion 274, and a sixth top winding layer portion 275 that are positioned in substantially the same direction as the bottom winding layer portions 260, 261, 262, 263, 264 of the first magnetic powder sheet 210. These top winding layer portions 270, 271, 272, 273, 274, 275 are positioned in a non-contacting relationship to one another. These top winding layer portions 270, 271, 272, 273, 274, 275 are also located on the upper surface 244 of the fourth magnetic powder sheet 240. Although the top winding layer portions 270, 271, 272, 273, 274, 275 are positioned in substantially the same direction as the bottom layer winding portions 260, 261, 262, 263, 264, there is a small angle formed between their directions so that they may be properly connected to one another.

Each of the top winding layer portions 270, 271, 272, 273, 274, 275 comprise two vias for coupling the top winding layer portions 270, 271, 272, 273, 274, 275 to a respective bottom winding layer portions 260, 261, 262, 263, 264, and to a respective terminal 216, 218, which is described in detail below.

The top winding layer portions 270, 271, 272, 273, 274, 275, the bottom winding layer portions 260, 261, 262, 263, 264, and the terminals 216, 218 may be formed by any of the methods described above, which includes, but is not limited to, a stamped copper foil, an etched copper trace, or a pre-formed coil.

Upon Ruining the first magnetic powder sheet 210 and the fourth magnetic powder sheet 240, the second magnetic sheet 220 and the third magnetic sheet 230 are placed between the first magnetic powder sheet 210 and the fourth magnetic powder sheet 240. The magnetic powder sheets 210, 220, 230, 240 are then pressed together with high pressure, for example, hydraulic pressure, and laminated together to form the miniature power inductor 200. After the sheets 210, 220, 230, 240 have been pressed together, the vias 280, 281, 282, 283, 284, 285, 290, 291, 292, 293, 294, 295 are formed, in accordance to the description provided for FIGS. 1*a*-1*c*. Additionally, a coating or epoxy (not shown) may be applied as an insulator layer to the upper surface 244 of the fourth magnetic powder sheet 240. According to this embodiment, the physical gap between the winding and the core, which is typically found in conventional inductors, is removed. The elimination of this physical gap tends to minimize the audible noise from the vibration of the winding.

The winding 250 forms a second winding configuration 255 having a horizontally oriented core 257. The second winding configuration 255 starts at the first terminal 216, then proceeds to the first top winding layer portion 270 through via 280, then proceeds to the first bottom winding layer portion 260 through via 290, then proceeds to the second top winding layer portion 271 through via 281, then proceeds to the second bottom winding layer portion 261 through via 291, then proceeds to the third top winding layer portion 272 through via 282, then proceeds to the third bottom winding layer portion 262 through via 292, then proceeds to the fourth top winding layer portion 273 through via 283, then proceeds to the fourth bottom winding layer portion 263 through via 293, then proceeds to the fifth top winding layer portion 274 through via 284, then proceeds to the fifth bottom winding layer portion 264 through via 294, then proceeds to the sixth top winding layer portion 275 through via 285, then proceeds to the second terminal 218 through via 295. In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

The miniature power inductor 200 is depicted as square shape. However, other geometrical shapes, including but not limited to rectangular, circular, or elliptical shapes, may be used without departing from the scope and spirit of the exemplary embodiment. Also, although this embodiment depicts six top winding layer portions and five bottom winding layer portions, the number of top and bottom winding layer portions may increase or decrease depending upon application requirements, so long as that there is one more top winding layer portion than bottom winding layer portion, without departing from the scope and spirit of the exemplary embodiment.

Figure 3A:
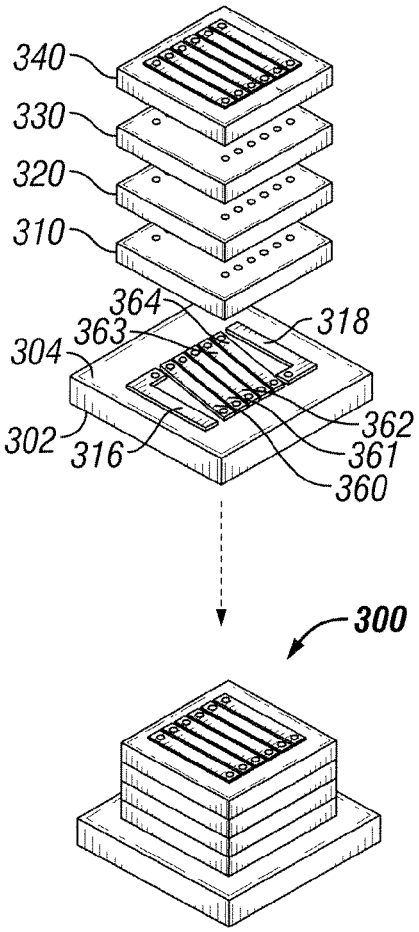
FIG. 3*a* illustrates a perspective view and an exploded view of the top side of a miniature power inductor having a portion of a winding in the second winding configuration and at least one terminal located on a printed circuit board, at least one magnetic powder sheet and a horizontally oriented core area in accordance with an exemplary embodiment.
Figure 3B:
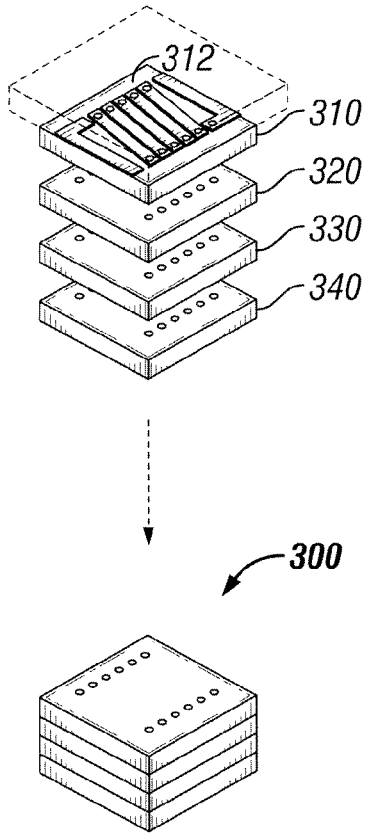
FIG. 3*b* illustrates a perspective view and an exploded view of the bottom side of the miniature power inductor as depicted in FIG. 3*a* in accordance with an exemplary embodiment.
Figure 3C:
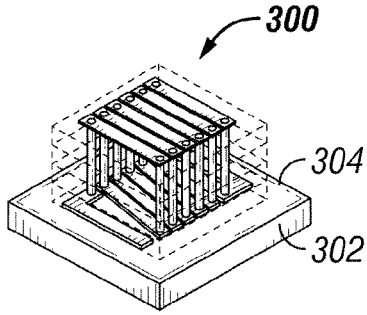
FIG. 3*c* illustrates a perspective view of the second winding configuration of the miniature power inductor as depicted in FIG. 3*a* and FIG. 3*b* in accordance with an exemplary embodiment.

Referring to FIGS. 3*a*-3*c*, several views of a third illustrative embodiment of a magnetic component or device 300 are shown. FIG. 3*a* illustrates a perspective view and an exploded view of the top side of a miniature power inductor having a portion of a winding in the second winding configuration and at least one terminal located on a printed circuit board, at least one magnetic powder sheet and a horizontally oriented core area in accordance with an exemplary embodiment. FIG. 3*b* illustrates a perspective view and an exploded view of the bottom side of the miniature power inductor as depicted in FIG. 3*a* in accordance with an exemplary embodiment. FIG. 3*c* illustrates a perspective view of the second winding configuration of the miniature power inductor as depicted in FIG. 3*a* and FIG. 3*b* in accordance with an exemplary embodiment.

The miniature power inductor 300 shown in FIGS. 3*a*-3*c* is similar to the miniature power inductor 200 shown in FIGS. 2*a*-2*c* except that a first terminal 316, a second terminal 318, and a plurality of bottom winding layer portions 360, 361, 362, 363, 364 are now located on the upper surface 304 of a substrate 302, instead of on the lower surface 312 of a first magnetic powder sheet 310. To maintain a similar thickness and performance of the miniature power inductor, as shown in FIGS. 2*a*-2*c*, the first magnetic powder sheet 310 is utilized in the manufacturing of the miniature power inductor 300 and comprises a plurality of vias, similar to a second magnetic powder sheet 320 and a third magnetic powder sheet 330. Thus, once the four magnetic powder sheets 310, 320, 330, 340 are laminated together, the miniature power inductor 300 is not completely formed until it is coupled to the substrate 302 having the proper terminals 316, 318 and the plurality of bottom winding layer portions 360, 361, 362, 363, 364. The pressed magnetic powder sheets 310, 320, 330, 340 may be coupled to the substrate 302 in any known manner, including but not limited to soldering of each of the vias to the substrate 302. According to this embodiment, the substrate 302 may include, but is not limited to, a printed circuit board and/or other substrates that are capable of having terminals and the plurality of bottom winding layer portions formed thereon. The manufacturing of the miniature power inductor 300 will have most, if not all, of the flexibilities of the miniature power inductor 200, as illustrated and described with respect to FIGS. 2*a*-2*c*.

Figure 4A:
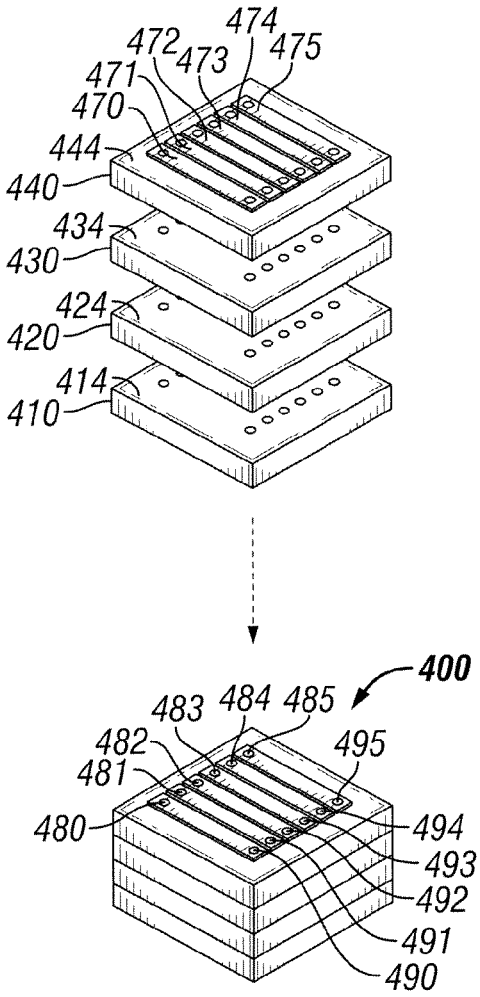
FIG. 4*a* illustrates a perspective view and an exploded view of the top side of a miniature power inductor having a plurality of windings in a third winding configuration, at least one magnetic powder sheet and a horizontally oriented core area in accordance with an exemplary embodiment.
Figure 4B:
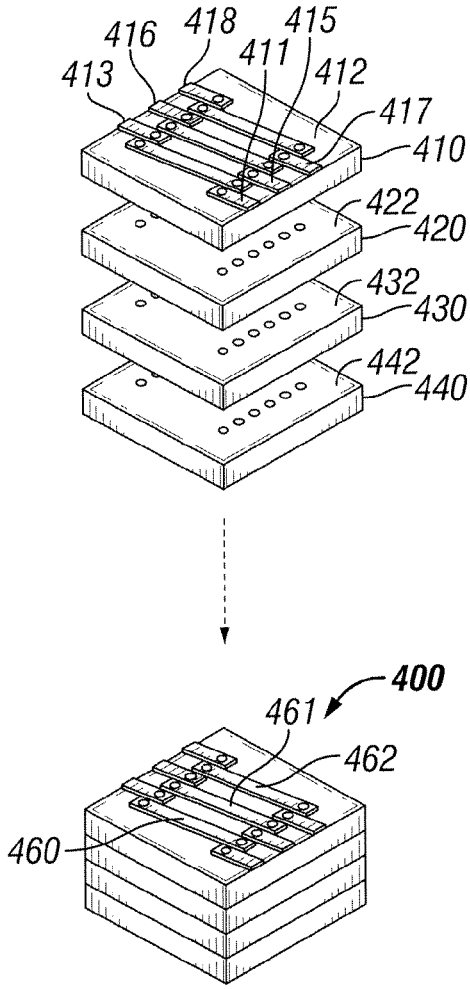
FIG. 4*b* illustrates a perspective view and an exploded view of the bottom side of the miniature power inductor as depicted in FIG. 4*a* in accordance with an exemplary embodiment.
Figure 4C:
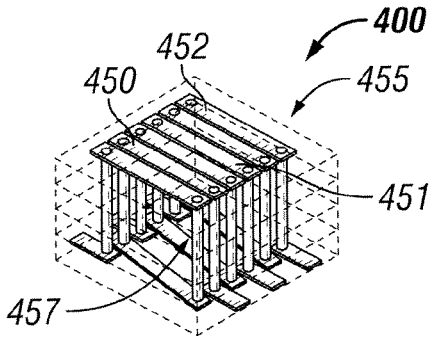
FIG. 4*c* illustrates a perspective view of the third winding configuration of the miniature power inductor as depicted in FIG. 4*a* and FIG. 4*b* in accordance with an exemplary embodiment.

Referring to FIGS. 4*a*-4*c*, several views of a fourth illustrative embodiment of a magnetic component or device 400 are shown. FIG. 4*a* illustrates a perspective view and an exploded view of the top side of a miniature power inductor having a plurality of windings in a third winding configuration, at least one magnetic powder sheet and a horizontally oriented core area in accordance with an exemplary embodiment. FIG. 4*b* illustrates a perspective view and an exploded view of the bottom side of the miniature power inductor as depicted in FIG. 4*a* in accordance with an exemplary embodiment. FIG. 4*c* illustrates a perspective view of the third winding configuration of the miniature power inductor as depicted in FIG. 4*a* and FIG. 4*b* in accordance with an exemplary embodiment.

According to this embodiment, the miniature power inductor 400 comprises at least one magnetic powder sheet 410, 420, 430, 440 and a plurality of windings 450, 451, 452 coupled to the at least one magnetic powder sheet 410, 420, 430, 440 in a third winding configuration 455. As seen in this embodiment, the miniature power inductor 400 comprises a first magnetic powder sheet 410 having a lower surface 412 and an upper surface 414, a second magnetic powder sheet 420 having a lower surface 422 and an upper surface 424, a third magnetic powder sheet 430 having a lower surface 432 and an upper surface 434, and a fourth magnetic powder sheet 440 having a lower surface 442 and an upper surface 444. As previously mentioned, the exemplary magnetic powder sheets can be magnetic powder sheets manufactured by Chang Sung Incorporated in Incheon, Korea and sold under product number 20u-eff Flexible Magnetic Sheet, and have the same characteristics as described above. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

The first magnetic powder sheet 410 also includes a first terminal 411, a second terminal 413, a third terminal 415, a fourth terminal 416, a fifth terminal 417, and a sixth terminal 418. There are two terminals for each winding 450, 451, 452. The first terminal 411 and the second terminal 413 are coupled to opposing sides of the lower surface 412 of the first magnetic powder sheet 410. The third terminal 415 and the fourth terminal 416 are coupled to opposing sides of the lower surface 412 of the first magnetic powder sheet 410. The fifth terminal 417 and the sixth terminal 418 are coupled to opposing sides of the lower surface 412 of the first magnetic powder sheet 410. Additionally, the first terminal 411, the third terminal 415, and the fifth terminal 417 are positioned adjacent to one another and along one edge of the lower surface 412 of the first magnetic powder sheet 410, while the second terminal 413, the fourth terminal 416, and the sixth terminal 418 are positioned adjacent to one another and along the opposing edge of the lower surface 412 of the first magnetic powder sheet 410. These terminals 411, 413, 415, 416, 417, 418 may be used to couple the miniature power inductor 400 to an electrical circuit, which may be on a printed circuit board (not shown), for example.

The first magnetic powder sheet 410 also includes a first bottom winding layer portion 460, a second bottom winding layer portion 461, and a third bottom winding layer portion 462 that are all positioned in substantially the same direction as the terminals 411, 413, 415, 416, 417, 418 and on the lower surface 412 of the first magnetic powder sheet 410. The first bottom winding layer portion 460 is positioned between the first terminal 411 and the second terminal 413 and in a non-contacting relationship to one another. The first bottom winding layer portion 460, the first terminal 411, and the second terminal 413 combine to form a portion of the first winding 450. Additionally, the second bottom winding layer portion 461 is positioned between the third terminal 415 and the fourth terminal 416 and in a non-contacting relationship to one another. The second bottom winding layer portion 461, the third terminal 415, and the fourth terminal 416 combine to form a portion of the second winding 451. Furthermore, the third bottom winding layer portion 462 is positioned between the fifth terminal 417 and the sixth terminal 418 and in a non-contacting relationship to one another. The third bottom winding layer portion 462, the fifth terminal 417, and the sixth terminal 418 combine to form a portion of the third winding 452.

Each of the terminals 411, 413, 415, 416, 417, 418 comprise a via 480, 482, 484, 491, 493, 495, respectively for coupling the terminals 411, 413, 415, 416, 417, 418 to one or more winding layers. Additionally, each of the bottom winding layer portions 460, 461, 462 comprise two vias for coupling the bottom winding layer portions 460, 461, 462 to a respective top winding layer portions 470, 471, 472, 473, 474, 475, which is described in detail below. As listed and previously mentioned, there is one additional top winding layer portion than bottom winding layer portion per winding.

The second magnetic powder sheet 420 and the third magnetic powder sheet 430 comprise a plurality of vias 480, 481, 482, 483, 484, 485, 490, 491, 492, 493, 494, 495 for coupling the terminals 411, 413, 415, 416, 417, 418, the bottom winding layer portions 460, 461, 462, and the top winding layer portions 470, 471, 472, 473, 474, 475 to one another.

The fourth magnetic powder sheet 440 also includes a first top winding layer portion 470, a second top winding layer portion 471, a third top winding layer portion 472, a fourth top winding layer portion 473, a fifth top winding layer portion 474, and a sixth top winding layer portion 475 that are positioned in substantially the same direction as the bottom winding layer portions 460, 461, 462 of the first magnetic powder sheet 410. These top winding layer portions 470, 471, 472, 473, 474, 475 are positioned in a non-contacting relationship to one another. These top winding layer portions 470, 471, 472, 473, 474, 475 are also located on the upper surface 444 of the fourth magnetic powder sheet 440. Although the top winding layer portions 470, 471, 472, 473, 474, 475 are positioned in substantially the same direction as the bottom layer winding portions 460, 461, 462, there is a small angle formed between their directions so that they may be properly connected to one another.

Each of the top winding layer portions 470, 471, 472, 473, 474, 475 comprise two vias for coupling the top winding layer portions 470, 471, 472, 473, 474, 475 to a respective bottom winding layer portions 460, 461, 462, and to a respective terminal 411, 413, 415, 416, 417, 418, which is described in detail below.

The top winding layer portions 470, 471, 472, 473, 474, 475, the bottom winding layer portions 460, 461, 462, and the terminals 411, 413, 415, 416, 417, 418 may be formed by any of the methods described above, which includes, but is not limited to, a stamped copper foil, an etched copper trace, or a preformed coil.

Upon forming the first magnetic powder sheet 410 and the fourth magnetic powder sheet 440, the second magnetic sheet 420 and the third magnetic sheet 430 are placed between the first magnetic powder sheet 410 and the fourth magnetic powder sheet 440. The magnetic powder sheets 410, 420, 430, 440 are then pressed together with high pressure, for example, hydraulic pressure, and laminated together to form the miniature power inductor 400. After the sheets 410, 420, 430, 440 have been pressed together, the vias 480, 481, 482, 483, 484, 485, 490, 491, 492, 493, 494, 495 are formed, in accordance to the description provided for FIGS. 1*a*-1*c*. Additionally, a coating or epoxy (not shown) may be applied as an insulator layer to the upper surface 444 of the fourth magnetic powder sheet 440. According to this embodiment, the physical gap between the winding and the core, which is typically found in conventional inductors, is removed. The elimination of this physical gap tends to minimize the audible noise from the vibration of the winding.

The windings 450, 451, 452 form a third winding configuration 455 having a horizontally oriented core 457. The first winding 450 starts at the first terminal 411, then proceeds to the first top winding layer portion 470 through via 480, then proceeds to the first bottom winding layer portion 460 through via 490, then proceeds to the second top winding layer portion 471 through via 481, then proceeds to the second terminal 413 through via 491, which then completes the first winding 450. The second winding 451 starts at the third terminal 415, then proceeds to the third top winding layer portion 472 through via 482, then proceeds to the second bottom winding layer portion 461 through via 492, then proceeds to the fourth top winding layer portion 473 through via 483, then proceeds to the fourth terminal 416 through via 493, which then completes the second winding 451. The third winding 452 starts at the fifth terminal 417, then proceeds to the fifth top winding layer portion 474 through via 484, then proceeds to the third bottom winding layer portion 462 through via 494, then proceeds to the sixth top winding layer portion 475 through via 485, then proceeds to the sixth terminal 418 through via 495, which then completes the third winding 452.

Although three windings are depicted in this embodiment, greater or fewer windings may be formed without departing from the scope and spirit of the exemplary embodiment. Additionally, the three windings may be mounted onto a substrate (not shown) or printed circuit board in a parallel arrangement or in a series arrangement depending upon the application and requirements that are needed. This flexibility allows this miniature power inductor 400 to be utilized as an inductor or as a transformer.

In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

The miniature power inductor 400 is depicted as square shape. However, other geometrical shapes, including but not limited to rectangular, circular, or elliptical shapes, may be used without departing from the scope and spirit of the exemplary embodiment. Also, although this embodiment depicts two top winding layer portions and one bottom winding layer portion for each winding, the number of top and bottom winding layer portions may increase depending upon application requirements, so long as that there is one more top winding layer portion than bottom winding layer portion for each winding, without departing from the scope and spirit of the exemplary embodiment.

Figure 5A:
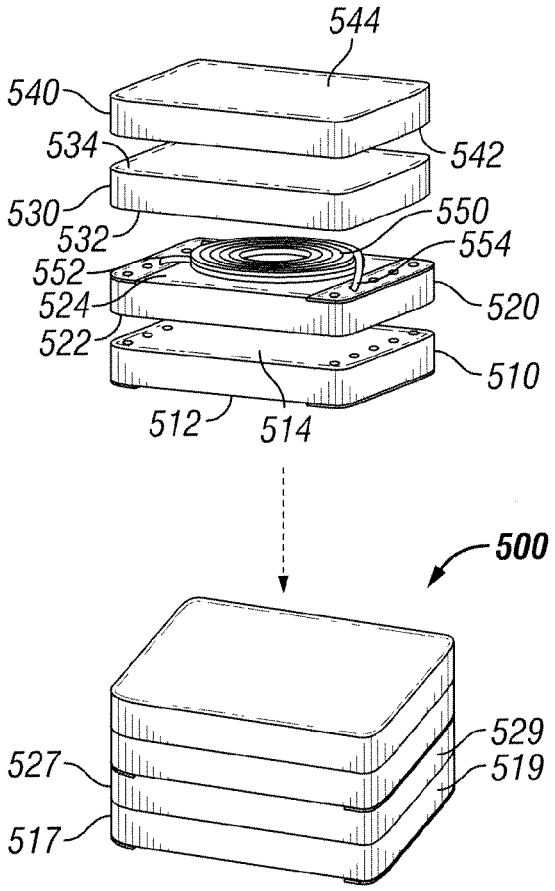
FIG. 5*a* illustrates a perspective view and an exploded view of the top side of a miniature power inductor having a preformed coil and at least one magnetic powder sheet in accordance with an exemplary embodiment.
Figure 5B:
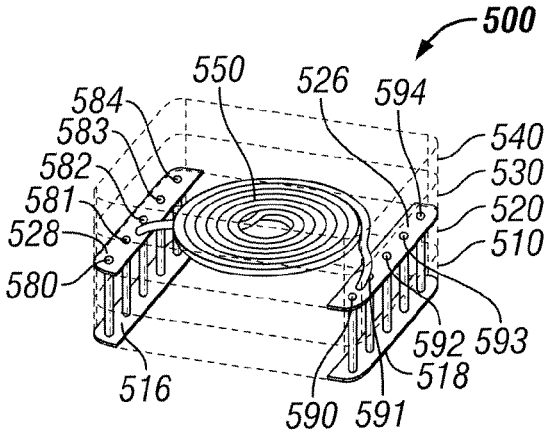
FIG. 5*b* illustrates a perspective transparent view of the miniature power inductor as depicted in FIG. 5*a* in accordance with an exemplary embodiment.

Referring to FIGS. 5*a*-5*b*, several views of a fifth illustrative embodiment of a magnetic component or device 500 are shown. FIG. 5*a* illustrates a perspective view and an exploded view of the top side of a miniature power inductor having a preformed coil and at least one magnetic powder sheet in accordance with an exemplary embodiment. FIG. 5*b* illustrates a perspective transparent view of the miniature power inductor as depicted in FIG. 5*a* in accordance with an exemplary embodiment.

According to this embodiment, the miniature power inductor 500 comprises at least one magnetic powder sheet 510, 520, 530, 540 and at least one preformed coil 550 coupled to the at least one magnetic powder sheet 510, 520, 530, 540. As seen in this embodiment, the miniature power inductor 500 comprises a first magnetic powder sheet 510 having a lower surface 512 and an upper surface 514, a second magnetic powder sheet 520 having a lower surface 522 and an upper surface 524, a third magnetic powder sheet 530 having a lower surface 532 and an upper surface 534, and a fourth magnetic powder sheet 540 having a lower surface 542 and an upper surface 544. As previously mentioned, the exemplary magnetic powder sheets can be magnetic powder sheets manufactured by Chang Sung Incorporated in Incheon, Korea and sold under product number 20u-eff Flexible Magnetic Sheet, and have the same characteristics as described above. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment. Moreover, although this embodiment depicts the use of one preformed coil, additional preformed coils may be used with the addition of more magnetic powder sheets by altering one or more of the terminations so that the more than one preformed coils may be positioned in parallel or in series, without departing from the scope and spirit of the exemplary embodiment.

The first magnetic powder sheet 510 also includes a first terminal 516 and a second terminal 518 coupled to opposing longitudinal sides of the lower surface 512 of the first magnetic powder sheet 510. According to this embodiment, the terminals 516, 518 extend the entire length of the longitudinal side. Although this embodiment depicts the terminals extending along the entire opposing longitudinal sides, the terminals may extend only a portion of the opposing longitudinal sides without departing from the scope and spirit of the exemplary embodiment. Additionally, these terminals 516, 518 may be used to couple the miniature power inductor 500 to an electrical circuit, which may be on a printed circuit board (not shown), for example.

The second magnetic powder sheet 520 also includes a third terminal 526 and a fourth terminal 528 coupled to opposing longitudinal sides of the lower surface 522 of the second magnetic powder sheet 520. According to this embodiment, the terminals 526, 528 extend the entire length of the longitudinal side, similar to the terminals 516, 518 of the first magnetic powder sheet 510. Although this embodiment depicts the terminals extending along the entire opposing longitudinal sides, the terminals may extend only a portion of the opposing longitudinal sides without departing from the scope and spirit of the exemplary embodiment. Additionally, these terminals 526, 528 may be used to couple the first terminal 516 and the second terminal 518 to the at least one preformed coil 550.

The terminals 516, 518, 526, 528 may be formed by any of the methods described above, which includes, but is not limited to, a stamped copper foil or etched copper trace.

Each of the first magnetic powder sheet 510 and the second magnetic powder sheet 520 further include a plurality of vias 580, 581, 582, 583, 584, 590, 591, 592, 593, 594 extending from the upper surface 524 of the second magnetic powder sheet 520 to the lower surface 512 of the first magnetic powder sheet 510. As shown in this embodiment, these plurality of vias 580, 581, 582, 583, 584, 590, 591, 592, 593, 594 are positioned on the terminals 516, 518, 526, 528 in a substantially linear pattern. There are five vias positioned along one of the edges of the first magnetic powder sheet 510 and the second magnetic powder sheet 520, and there are five vias positioned along the opposing edge of the first magnetic powder sheet 510 and the second magnetic powder sheet 520. Although five vias are shown along each of the opposing longitudinal edges, there may be greater or fewer vias without departing from the scope and spirit of the exemplary embodiment. Additionally, although vias are used to couple first and second terminals 516, 518 to third and fourth terminals 526, 528, alternative coupling may be used without departing from the scope and spirit of the exemplary embodiment. One such alternative coupling includes, but is not limited to, metal plating along at least a portion of the opposing side faces 517, 519, 527, 529 of both first magnetic powder sheet 510 and second magnetic powder sheet 520 and extending from the first and second terminals 516, 518 to the third and fourth terminals 526, 528. Also, in some embodiments, the alternative coupling may include metal plating that extends the entire opposing side faces 517, 519, 527, 529 and also wraps around the opposing side faces 517, 519, 527, 529. According to some embodiments, alternative coupling, such as the metal plating of the opposing side faces, may be used in addition to or in lieu of the vias; or alternatively, the vias may be used in addition to or in lieu of the alternative coupling, such as metal plating of the opposing side faces.

Upon forming the first magnetic powder sheet 510 and the second magnetic powder sheet 520, the first magnetic powder sheet 510 and the second magnetic powder sheet 520 are pressed together with high pressure, for example, hydraulic pressure, and laminated together to form a portion of the miniature power inductor 500. After sheets 510, 520 have been pressed together, the vias 580, 581, 582, 583, 584, 590, 591, 592, 593, 594 are formed, in accordance to the description provided for FIGS. 1*a*-1*c*. In place of forming the vias, other terminations may be made between the two sheets 510, 520 without departing from the scope and spirit of the exemplary embodiment. Once the first magnetic powder sheet 510 and the second magnetic powder sheet 520 are pressed together, a preformed winding or coil 550 having a first lead 552 and a second lead 554 may be positioned on the upper surface 524 of the second magnetic powder sheet 520, where the first lead 552 is coupled to either the third terminal 526 or the fourth terminal 528 and the second lead is coupled to the other terminal 526, 528. The preformed winding 550 may be coupled to the terminals 526, 528 via welding other known coupling methods. The third magnetic powder sheet 530 and the fourth magnetic powder sheet 540 may then be pressed together along with the previously pressed portion of the miniature power inductor 500 to form the completed miniature power inductor 500. According to this embodiment, the physical gap between the winding and the core, which is typically found in conventional inductors, is removed. The elimination of this physical gap tends to minimize the audible noise from the vibration of the winding.

Although there are no magnetic sheets shown between the first and second magnetic powder sheets, magnetic sheets may positioned between the first and second magnetic powder sheets so long as there remains an electrical connection between the terminals of the first and second magnetic powder sheets without departing from the scope and spirit of the exemplary embodiment. Additionally, although two magnetic powder sheets are shown to be positioned above the preformed coil, greater or fewer sheets may be used to increase or decrease the core area without departing from the scope and spirit of the exemplary embodiment.

In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

The miniature power inductor 500 is depicted as a rectangular shape. However, other geometrical shapes, including but not limited to square, circular, or elliptical shapes, may be used without departing from the scope and spirit of the exemplary embodiment.

Figure 6A:
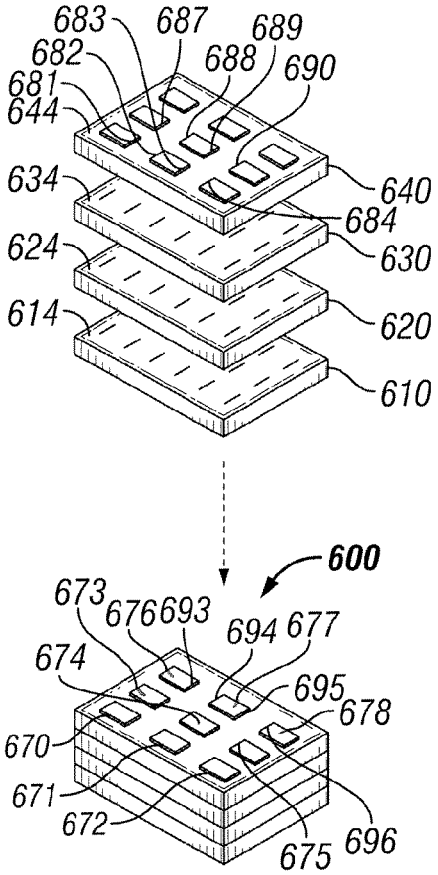
FIG. 6*a* illustrates a perspective view and an exploded view of the top side of a miniature power inductor having a plurality of windings in a fourth winding configuration, at least one magnetic powder sheet, and a plurality of horizontally oriented core areas in accordance with an exemplary embodiment.
Figure 6B:
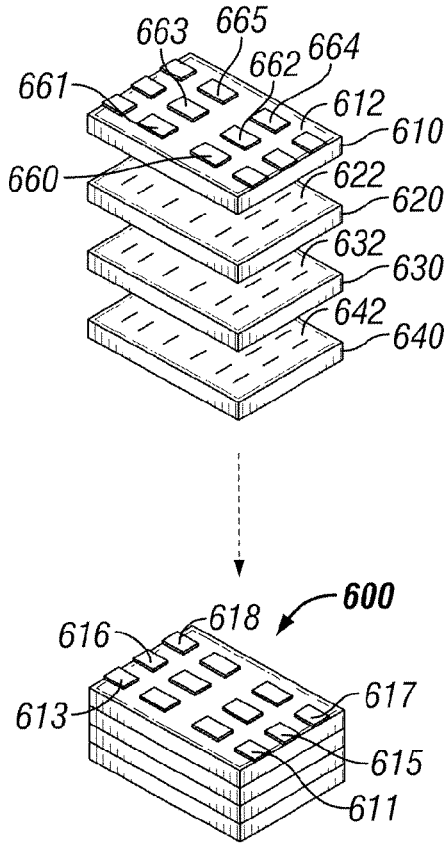
FIG. 6*b* illustrates a perspective view and an exploded view of the bottom side of the miniature power inductor as depicted in FIG. 6*a* in accordance with an exemplary embodiment.
Figure 6C:
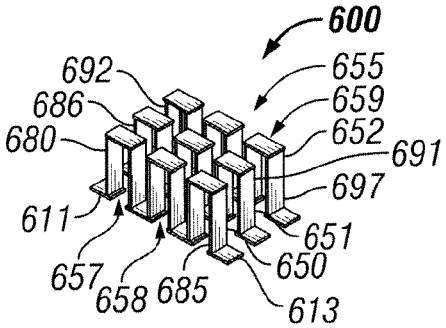
FIG. 6*c* illustrates a perspective view of the fourth winding configuration of the miniature power inductor as depicted in FIG. 6*a* and FIG. 6*b* in accordance with an exemplary embodiment.

Referring to FIGS. 6*a*-6*c*, several views of a sixth illustrative embodiment of a magnetic component or device 600 are shown. FIG. 6*a* illustrates a perspective view and an exploded view of the top side of a miniature power inductor having a plurality of windings in a fourth winding configuration, at least one magnetic powder sheet, and a plurality of horizontally oriented core areas in accordance with an exemplary embodiment. FIG. 6*b* illustrates a perspective view and an exploded view of the bottom side of the miniature power inductor as depicted in FIG. 6*a* in accordance with an exemplary embodiment. FIG. 6*c* illustrates a perspective view of the fourth winding configuration of the miniature power inductor as depicted in FIG. 6*a* and FIG. 6*b* in accordance with an exemplary embodiment.

According to this embodiment, the miniature power inductor 600 comprises at least one magnetic powder sheet 610, 620, 630, 640 and a plurality of windings 650, 651, 652 coupled to the at least one magnetic powder sheet 610, 620, 630, 640 in a fourth winding configuration 655. As seen in this embodiment, the miniature power inductor 600 comprises a first magnetic powder sheet 610 having a lower surface 612 and an upper surface 614, a second magnetic powder sheet 620 having a lower surface 622 and an upper surface 624, a third magnetic powder sheet 630 having a lower surface 632 and an upper surface 634, and a fourth magnetic powder sheet 640 having a lower surface 642 and an upper surface 644. As previously mentioned, the exemplary magnetic powder sheets can be magnetic powder sheets manufactured by Chang Sung Incorporated in Incheon, Korea and sold under product number 20u-eff Flexible Magnetic Sheet, and have the same characteristics as described above. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any suitable flexible sheet may be used that is capable of being laminated, without departing from the scope and spirit of the exemplary embodiment.

The first magnetic powder sheet 610 also includes a first terminal 611, a second terminal 613, a third terminal 615, a fourth terminal 616, a fifth terminal 617, and a sixth terminal 618. There are two terminals for each winding 650, 651, 652. The first terminal 611 and the second terminal 613 are coupled to opposing sides of the lower surface 612 of the first magnetic powder sheet 610. The third terminal 615 and the fourth terminal 616 are coupled to opposing sides of the lower surface 612 of the first magnetic powder sheet 610. The fifth terminal 617 and the sixth terminal 618 are coupled to opposing sides of the lower surface 612 of the first magnetic powder sheet 610. Additionally, the first terminal 611, the third terminal 615, and the fifth terminal 617 are positioned adjacent to one another and along one edge of the lower surface 612 of the first magnetic powder sheet 610, while the second terminal 613, the fourth terminal 616, and the sixth terminal 618 are positioned adjacent to one another and along the opposing edge of the lower surface 612 of the first magnetic powder sheet 610. These terminals 611, 613, 615, 616, 617, 618 may be used to couple the miniature power inductor 600 to an electrical circuit, which may be on a printed circuit board (not shown), for example.

The first magnetic powder sheet 610 also includes a first bottom winding layer portion 660, a second bottom winding layer portion 661, a third bottom winding layer portion 662, a fourth bottom winding layer portion 663, a fifth bottom winding layer portion 664, and a sixth bottom winding layer portion 665 that are all positioned in substantially the same direction as the terminals 611, 613, 615, 616, 617, 618 and on the lower surface 612 of the first magnetic powder sheet 610. The first bottom winding layer portion 660 and the second bottom winding layer portion 661 are positioned between the first terminal 611 and the second terminal 613 and in a non-contacting relationship to one another. The first terminal 611, the first bottom winding layer portion 660, the second bottom winding layer portion 661, and the second terminal 613 are positioned in a substantially linear pattern and in that order. The first terminal 611, the first bottom winding layer portion 660, the second bottom winding layer portion 661, and the second terminal 613 combine to form a portion of the first winding 650. Additionally, the third bottom winding layer portion 662 and the fourth bottom winding layer portion 663 are positioned between the third terminal 615 and the fourth terminal 616 and in a non-contacting relationship to one another. The third terminal 615, the third bottom winding layer portion 662, the fourth bottom winding layer portion 663, and the fourth terminal 616 are positioned in a substantially linear pattern and in that order. The third terminal 615, the third bottom winding layer portion 662, the fourth bottom winding layer portion 663, and the fourth terminal 616 combine to form a portion of the second winding 651. Furthermore, the fifth bottom winding layer portion 664 and the sixth bottom winding layer portion 665 are positioned between the fifth terminal 617 and the sixth terminal 618 and in a non-contacting relationship to one another. The fifth terminal 617, the fifth bottom winding layer portion 664, the sixth bottom winding layer portion 665, and the sixth terminal 618 are positioned in a substantially linear pattern and in that order. The fifth terminal 617, the fifth bottom winding layer portion 664, the sixth bottom winding layer portion 665, and the sixth terminal 618 combine to form a portion of the third winding 652.

Each of the terminals 611, 613, 615, 616, 617, 618 comprise a via 680, 685, 686, 691, 692, 697, respectively for coupling the terminals 611, 613, 615, 616, 617, 618 to one or more winding layers. Additionally, each of the bottom winding layer portions 660, 661, 662, 663, 664, 665 comprise two vias for coupling the bottom winding layer portions 660, 661, 662, 663, 664, 665 to a top winding layer portion 670, 671, 672, 673, 674, 675, 676, 677, 678 which is described in detail below. As listed and previously mentioned, there is one additional top winding layer portion than bottom winding layer portion per winding. Although the vias are shown to be rectangular, other geometric shapes, including but not limited to circular shapes, may be used without departing from the scope and spirit of the exemplary embodiment.

The second magnetic powder sheet 620 and the third magnetic powder sheet 630 comprise a plurality of vias 680, 681, 682, 683, 684, 685, 686, 687, 688, 689, 690, 691, 692, 693, 694, 695, 696, 697 for coupling the terminals 611, 613, 615, 616, 617, 618, the bottom winding layer portions 660, 661, 662, 663, 664, 665, and the top winding layer portions 670, 671, 672, 673, 674, 675, 676, 677, 678 to one another.

The fourth magnetic powder sheet 640 also includes a first top winding layer portion 670, a second top winding layer portion 671, a third top winding layer portion 672, a fourth top winding layer portion 673, a fifth top winding layer portion 674, a sixth top winding layer portion 675, a seventh top winding layer portion 676, an eighth top winding layer portion 677, and a ninth top winding layer portion 678 that are positioned in substantially the same direction as the bottom winding layer portions 660, 661, 662, 663, 664, 665 of the first magnetic powder sheet 610. These top winding layer portions 670, 671, 672, 673, 674, 675, 676, 677, 678 are positioned in a non-contacting relationship to one another. These top winding layer portions 670, 671, 672, 673, 674, 675, 676, 677, 678 are also located on the upper surface 644 of the fourth magnetic powder sheet 640. The first top winding layer portion 670, the second top winding layer portion 671, and the third top winding layer portion 672 are positioned overlying the gaps formed between the first terminal 611, the first bottom winding layer portion 660, the second bottom winding layer portion 661, and the second terminal 613 of the first magnetic powder sheet 610 and in an overlapping relationship. Additionally, the fourth top winding layer portion 673, the fifth top winding layer portion 674, and the sixth top winding layer portion 675 are positioned overlying the gaps formed between the third terminal 615, the third bottom winding layer portion 662, the fourth bottom winding layer portion 663, and the fourth terminal 616 of the first magnetic powder sheet 610 and in an overlapping relationship. Furthermore, the seventh top winding layer portion 676, the eighth top winding layer portion 677, and the ninth top winding layer portion 678 are positioned overlying the gaps formed between the fifth terminal 617, the fifth bottom winding layer portion 664, the sixth bottom winding layer portion 665, and the sixth terminal 618 of the first magnetic powder sheet 610 and in an overlapping relationship.

Each of the top winding layer portions 670, 671, 672, 673, 674, 675, 676, 677, 678 comprise two vias for coupling the top winding layer portions 670, 671, 672, 673, 674, 675, 676, 677, 678 to a respective bottom winding layer portions 660, 661, 662, 663, 664, 665, and to a respective terminal 611, 613, 615, 616, 617, 618, which is described in detail below.

The top winding layer portions 670, 671, 672, 673, 674, 675, 676, 677, 678, the bottom winding layer portions 670, 671, 672, 673, 674, 675, 676, 677, 678, and the terminals 611, 613, 615, 616, 617, 618 may be formed by any of the methods described above, which includes, but is not limited to, a stamped copper foil, an etched copper trace, or a preformed coil.

Upon forming the first magnetic powder sheet 610 and the fourth magnetic powder sheet 640, the second magnetic sheet 620 and the third magnetic sheet 630 are placed between the first magnetic powder sheet 610 and the fourth magnetic powder sheet 640. The magnetic powder sheets 610, 620, 630, 640 are then pressed together with high pressure, for example, hydraulic pressure, and laminated together to form the miniature power inductor 600. After the sheets 610, 620, 630, 640 have been pressed together, the vias 680, 681, 682, 683, 684, 685, 686, 687, 688, 689, 690, 691, 692, 693, 694, 695, 696, 697 are formed, in accordance to the description provided for FIGS. 1*a*-1*c*. Additionally, a coating or epoxy (not shown) may be applied as an insulator layer to the upper surface 644 of the fourth magnetic powder sheet 640. According to this embodiment, the physical gap between the winding and the core, which is typically found in conventional inductors, is removed. The elimination of this physical gap tends to minimize the audible noise from the vibration of the winding.

The windings 650, 651, 652 form a fourth winding configuration 655 having a plurality of horizontally oriented cores 657, 658, 659. The first winding 650 starts at the first terminal 611, then proceeds to the first top winding layer portion 670 through via 680, then proceeds to the first bottom winding layer portion 660 through via 681, then proceeds to the second top winding layer portion 671 through via 682, then proceeds to the second bottom winding layer portion 661 through via 683, then proceeds to the third top winding layer 672 through via 684, and then proceeds to the second terminal 613 through via 685, which then completes the first winding 650. The second winding 651 starts at the third terminal 615, then proceeds to the fourth top winding layer portion 673 through via 686, then proceeds to the third bottom winding layer portion 662 through via 687, then proceeds to the fifth top winding layer portion 674 through via 688, then proceeds to the fourth bottom winding layer portion 663 through via 689, then proceeds to the sixth top winding layer 675 through via 690, and then proceeds to the fourth terminal 616 through via 691, which then completes the second winding 651. The third winding 652 starts at the fifth terminal 617, then proceeds to the seventh top winding layer portion 676 through via 692, then proceeds to the fifth bottom winding layer portion 664 through via 693, then proceeds to the eighth top winding layer portion 677 through via 694, then proceeds to the sixth bottom winding layer portion 665 through via 695, then proceeds to the ninth top winding layer 678 through via 696, and then proceeds to the sixth terminal 618 through via 697, which then completes the second winding 652.

Although three windings are depicted in this embodiment, greater or fewer windings may be formed without departing from the scope and spirit of the exemplary embodiment. Additionally, the three windings may be mounted onto a substrate (not shown) or printed circuit board in a parallel arrangement or in a series arrangement depending upon the application and requirements that are needed. This flexibility allows this miniature power inductor 600 to be utilized as an inductor, a multi-phase inductor, or as a transformer.

In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

The miniature power inductor 600 is depicted as a rectangular shape. However, other geometrical shapes, including but not limited to square, circular, or elliptical shapes, may be used without departing from the scope and spirit of the exemplary embodiment. Also, although this embodiment depicts three top winding layer portions and two bottom winding layer portion for each winding, the number of top and bottom winding layer portions may increase or decrease depending upon application requirements, so long as that there is one more top winding layer portion than bottom winding layer portion for each winding, without departing from the scope and spirit of the exemplary embodiment.

Figure 7A:
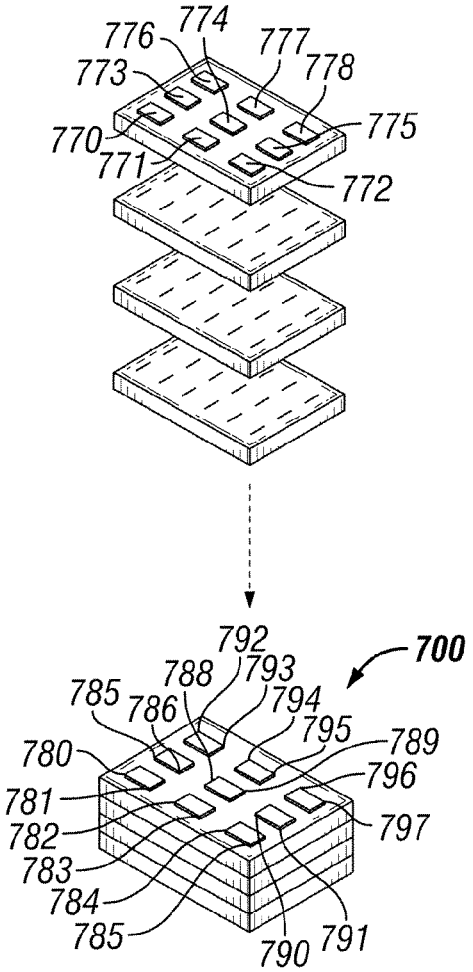
FIG. 7*a* illustrates a perspective view and an exploded view of the top side of a miniature power inductor having a winding in a fifth winding configuration, at least one magnetic powder sheet, and a plurality of horizontally oriented core areas in accordance with an exemplary embodiment.
Figure 7B:
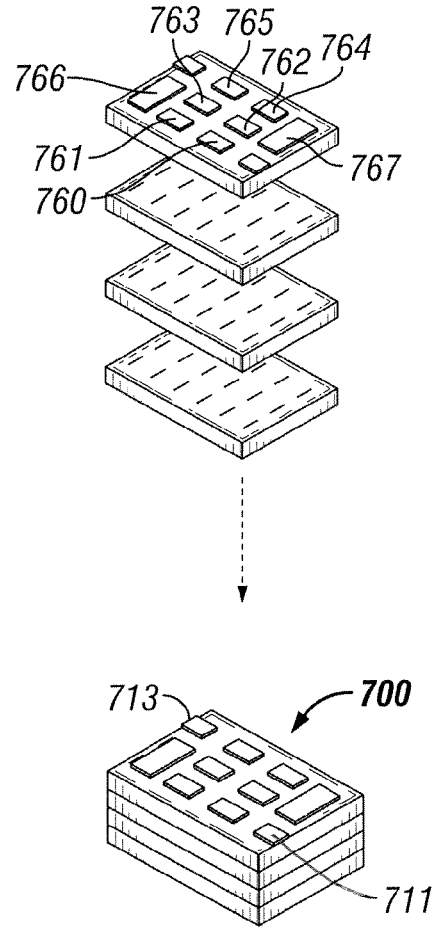
FIG. 7*b* illustrates a perspective view and an exploded view of the bottom side of the miniature power inductor as depicted in FIG. 7*a* in accordance with an exemplary embodiment.
Figure 7C:
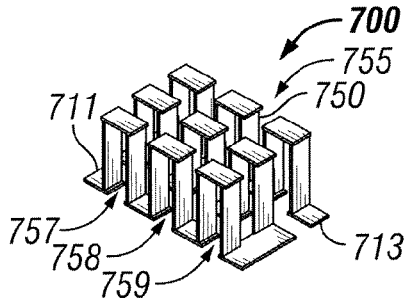
FIG. 7*c* illustrates a perspective view of the fifth winding configuration of the miniature power inductor as depicted in FIG. 7*a* and FIG. 7*b* in accordance with an exemplary embodiment.

Referring to FIGS. 7*a*-7*c*, several views of a seventh illustrative embodiment of a magnetic component or device 700 are shown. FIG. 7*a* illustrates a perspective view and an exploded view of the top side of a miniature power inductor having a winding in a fifth winding configuration, at least one magnetic powder sheet, and a plurality of horizontally oriented core areas in accordance with an exemplary embodiment. FIG. 7*b* illustrates a perspective view and an exploded view of the bottom side of the miniature power inductor as depicted in FIG. 7*a* in accordance with an exemplary embodiment. FIG. 7*c* illustrates a perspective view of the fifth winding configuration of the miniature power inductor as depicted in FIG. 7*a* and FIG. 7*b* in accordance with an exemplary embodiment.

The miniature power inductor 700 shown in FIGS. 7*a*-7*c* is similar to the miniature power inductor 600 shown in FIGS. 6*a*-6*c* except that the three windings 650, 651, 652 shown in FIGS. 6*a*-6*c* are now a single winding 750 as shown in FIGS. 7*a*-7*c*. This modification may occur by replacing the second terminal 613 and the fourth terminal 616 of the first magnetic powder sheet 610 with a seventh bottom winding layer portion 766 that is oriented substantially perpendicular to the remaining bottom winding layers 760, 761, 762, 763, 764, 765. The seventh bottom winding layer portion 766 may be a length sufficient to overlap the width of two bottom winding layer portions and the gap formed between the two adjacent bottom winding layer portions. Additionally, the third terminal 615 and the fifth terminal 617 of the first magnetic powder sheet 610 (as shown in FIGS. 6*a*-6*c*) may be replaced with an eighth bottom winding layer portion 767 that is oriented substantially perpendicular to the remaining bottom winding layers 760, 761, 762, 763, 764, 765. The eighth bottom winding layer portion 767 also may be a length sufficient to overlap the width of two bottom winding layer portions and the gap formed between the two adjacent bottom winding layer portions. With these modifications, the multi-phase inductor of FIGS. 6*a*-6*c* may be transformed into a single phase inductor.

The winding 750 form a fifth winding configuration 755 having a plurality of horizontally oriented cores 757, 758, 759. The winding 750 starts at the first terminal 711, then proceeds to the first top winding layer portion 770 through via 780, then proceeds to the first bottom winding layer portion 760 through via 781, then proceeds to the second top winding layer portion 771 through via 782, then proceeds to the second bottom winding layer portion 761 through via 783, then proceeds to the third top winding layer 772 through via 784, then proceeds to the seventh bottom winding layer portion 766 through via 785, then proceeds to the sixth top winding layer portion 775 through via 791, then proceeds to the fourth bottom winding layer portion 763 through via 790, then proceeds to the fifth top winding layer portion 774 through via 789, then proceeds to the third bottom winding layer portion 762 through via 788, then proceeds to the fourth top winding layer 773 through via 787, then proceeds to the eighth bottom winding layer portion 767 through via 786, then proceeds to the seventh top winding layer portion 776 through via 792, then proceeds to the fifth bottom winding layer portion 764 through via 793, then proceeds to the eighth top winding layer portion 777 through via 794, then proceeds to the sixth bottom winding layer portion 765 through via 795, then proceeds to the ninth top winding layer 778 through via 796, and then proceeds to the second terminal 713 through via 797, which then completes the winding 750. Thus, the pattern illustrated in this embodiment is serpentine; although, other patterns may be formed without departing from the scope and spirit of the exemplary embodiment.

The manufacturing of the miniature power inductor 700 will have most, if not all, of the flexibilities of the miniature power inductor 600, as illustrated and described with respect to FIGS. 6*a*-6*c*.

Figure 8A:
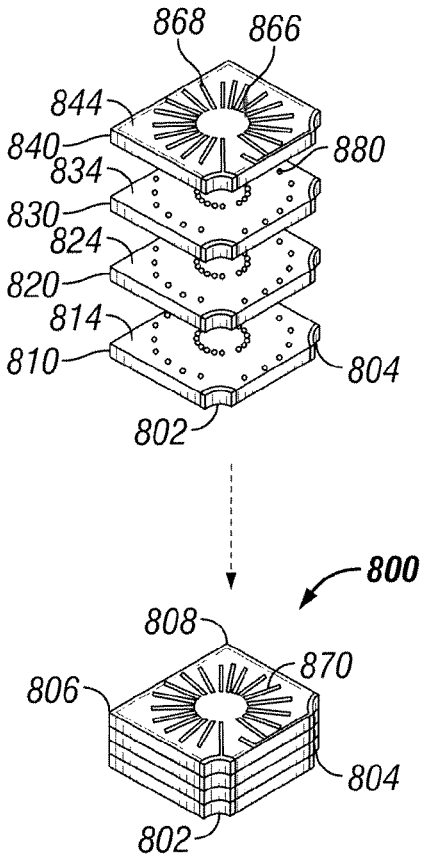
FIG. 8*a* illustrates a perspective view and an exploded view of the top side of a miniature power inductor having a winding in a sixth winding configuration, at least one magnetic powder sheet, and a vertically oriented core area and a circularly oriented core area in accordance with an exemplary embodiment.
Figure 8B:
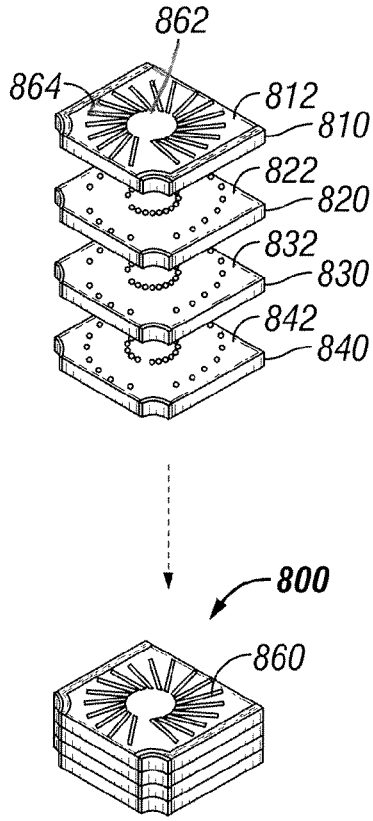
FIG. 8*b* illustrates a perspective view and an exploded view of the bottom side of the miniature power inductor as depicted in FIG. 8*a* in accordance with an exemplary embodiment.
Figure 8C:
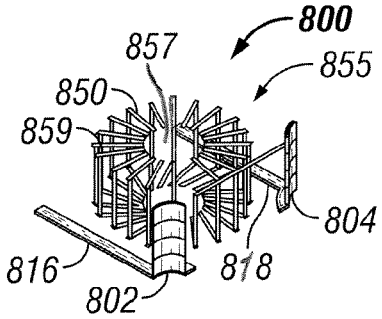
FIG. 8*c* illustrates a perspective view of the sixth winding configuration of the miniature power inductor as depicted in FIG. 8*a* and FIG. 8*b* in accordance with an exemplary embodiment.

Referring to FIGS. 8*a*-8*c*, several views of an eighth illustrative embodiment of a magnetic component or device 800 are shown. FIG. 8*a* illustrates a perspective view and an exploded view of the top side of a miniature power inductor having a winding in a sixth winding configuration, at least one magnetic powder sheet, and a vertically oriented core area and a circularly oriented core area in accordance with an exemplary embodiment. FIG. 8*b* illustrates a perspective view and an exploded view of the bottom side of the miniature power inductor as depicted in FIG. 8*a* in accordance with an exemplary embodiment. FIG. 8*c* illustrates a perspective view of the sixth winding configuration of the miniature power inductor as depicted in FIG. 8*a* and FIG. 8*b* in accordance with an exemplary embodiment;

According to this embodiment, the miniature power inductor 800 comprises at least one magnetic powder sheet 810, 820, 830, 840 and a winding 850 coupled to the at least one magnetic powder sheet 810, 820, 830, 840 in a sixth winding configuration 855. As seen in this embodiment, the miniature power inductor 800 comprises a first magnetic powder sheet 810 having a lower surface 812 and an upper surface 814, a second magnetic powder sheet 820 having a lower surface 822 and an upper surface 824, a third magnetic powder sheet 830 having a lower surface 832 and an upper surface 834, and a fourth magnetic powder sheet 840 having a lower surface 842 and an upper surface 844. As previously mentioned, the exemplary magnetic powder sheets can be magnetic powder sheets manufactured by Chang Sung Incorporated in Incheon, Korea and sold under product number 20u-eff Flexible Magnetic Sheet, and have the same characteristics as described above. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

The first magnetic powder sheet 810 has a first cutout 802 and a second cutout 804 positioned at adjacent corners of the first magnetic powder sheet 810. The first magnetic powder sheet 810 also includes a first terminal 816 extending from the first cutout 802 towards a first non-cutout corner 806 and coupled to a longitudinal side of the lower surface 812 of the first magnetic powder sheet 810. The first magnetic powder sheet 810 also includes a second terminal 818 extending from the second cutout 804 towards a second non-cutout corner 808 and coupled to an opposing longitudinal side of the lower surface 812 of the first magnetic powder sheet 810. Although this embodiment depicts the terminals extending the entire longitudinal side of the lower surface of the first magnetic powder sheet, the terminals may extend only a portion of the longitudinal side without departing from the scope and spirit of the exemplary embodiment. Also, although the terminals are shown to extend on opposing longitudinal sides, the terminals may extend a portion of the adjacent longitudinal sides without departing from the scope and spirit of the exemplary embodiment. These terminals 816, 818 may be used to couple the miniature power inductor 800 to an electrical circuit, which may be on a printed circuit board (not shown), for example.

The first magnetic powder sheet 810 also includes a plurality of bottom winding layer portions 860 that are all positioned to form a substantially circular pattern having an inner circumference 862 and an outer circumference 864. The plurality of bottom winding layer portions 860 extend from the inner circumference 862 to the outer circumference 864 at a slight angle from the shortest path from the inner circumference 862 to the outer circumference 864. The terminals 816, 818 and the plurality of bottom winding layer portions 860 are positioned in a non-contacting relationship to one another. These plurality of bottom winding layer portions 860 are also located on the lower surface 812 of the first magnetic powder sheet 810.

Each of the plurality of bottom winding layer portions 860 comprise two vias for coupling each of the plurality of bottom winding layer portions 860 to each of two adjacent plurality of top winding layer portions 870, which is described in detail below.

The second magnetic powder sheet 820 and the third magnetic powder sheet 830 comprise the first cutout 802 and the second cutout 804, similar to the first magnetic powder sheet 810, and a plurality of vias 880 for coupling the plurality of bottom winding layer portions 860 to the plurality of top winding layer portions 870 and the plurality of top winding layer portions 870 to the plurality of bottom winding layer portions 860 and each of the terminals 816, 818. The plurality of vias 880 correspond in position and location to the vias formed in the first magnetic powder sheet 810.

The fourth magnetic powder sheet 840 also includes the first cutout 802 and the second cutout 804, similar to the other magnetic powder sheets 810, 820, 830, and a plurality of top winding layer portions 870 that are all positioned to form a substantially circular pattern having an inner circumference 866 and an outer circumference 868. The plurality of top winding layer portions 870 extend from the inner circumference 866 to the outer circumference 868 according to the shortest path from the inner circumference 866 to the outer circumference 868. The plurality of top winding layer portions 870 are positioned in a non-contacting relationship to one another. These plurality of top winding layer portions 870 are also located on the upper surface 844 of the fourth magnetic powder sheet 840. The first cut out 802 and the second cutout 804 of each of the magnetic powder sheets 810, 820, 830, 840 are metallized to facilitate an electrical connection between one of the plurality of top winding layer portion 870 and a respective terminal 816, 818.

Although the plurality of top winding layer portions 870 are positioned in substantially the same direction as the plurality of bottom layer winding portions 860, there is a small angle formed between their directions so that they may be properly connected to one another. It is possible that the orientations of the plurality of top winding layer portions 870 and the plurality of bottom layer portions 860 may be reversed or slightly altered without departing from the scope and spirit of the exemplary embodiment.

Each of the plurality of top winding layer portions 870 comprise two vias for coupling the plurality of top winding layer portions 870 to the plurality of bottom winding layer portions 860 and to the terminals 816, 818.

The plurality of top winding layer portions 870, the plurality of bottom winding layer portions 860, and the terminals 816, 818 may be formed by any of the methods described above, which includes, but is not limited to, a stamped copper foil, an etched copper trace, or a preformed coil.

Upon forming the first magnetic powder sheet 810 and the fourth magnetic powder sheet 840, the second magnetic sheet 820 and the third magnetic sheet 830 are placed between the first magnetic powder sheet 810 and the fourth magnetic powder sheet 840. The magnetic powder sheets 810, 820, 830, 840 are then pressed together with high pressure, for example, hydraulic pressure, and laminated together to form the miniature power inductor 800. After the sheets 810, 820, 830, 840 have been pressed together, the plurality of vias 880 are formed, in accordance to the description provided for FIGS. 1*a*-1*c*. Additionally, a coating or epoxy (not shown) may be applied as an insulator layer to the upper surface 844 of the fourth magnetic powder sheet 840. According to this embodiment, the physical gap between the winding and the core, which is typically found in conventional inductors, is removed. The elimination of this physical gap tends to minimize the audible noise from the vibration of the winding.

The winding 850 forms a sixth winding configuration 855 having a vertically oriented core area 857 and a circularly oriented core area 859. The sixth winding configuration 855 starts at the first terminal 816, then proceeds to one of the plurality of top winding layer portion 870 through the metallized first cutout 802, then proceeds alternating through each of the plurality of bottom winding layer portions 860 and the plurality of top winding portions 870 through the plurality of vias 880 until the circular pattern is completed at one of the plurality of top winding layer portion 870. The sixth winding configuration 855 then proceeds to the second terminal 818 through the metallized second cutout 804. In this embodiment, the magnetic field created in the vertically oriented core area 857 may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded. Additionally, the magnetic field created in the circularly oriented core area 859 may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded. Although the pattern is shown to be circular or toroidal, the pattern may be any geometric shape, including but not limited to rectangular, without departing from the scope and spirit of the exemplary embodiment.

The miniature power inductor 800 is depicted as square shape. However, other geometrical shapes, including but not limited to rectangular, circular, or elliptical shapes, may be used without departing from the scope and spirit of the exemplary embodiment. Also, although this embodiment depicts twenty top winding layer portions and nineteen bottom winding layer portions, the number of top and bottom winding layer portions may increase or decrease depending upon application requirements, so long as that there is one more top winding layer portion than bottom winding layer portion, without departing from the scope and spirit of the exemplary embodiment. Additionally, although a one turn winding is depicted in this embodiment, more than one turn may be utilized without departing from the scope and spirit of the exemplary embodiment.

Figure 9A:
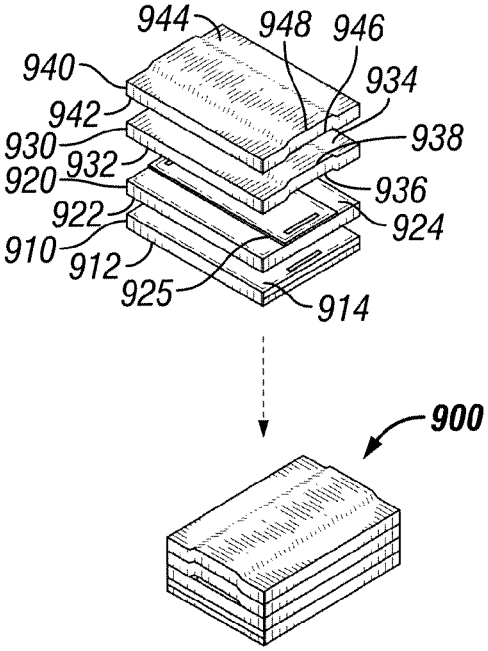
FIG. 9*a* illustrates a perspective view and an exploded view of the top side of a miniature power inductor having a one turn winding in a seventh winding configuration, at least one magnetic powder sheet, and a horizontally oriented core area in accordance with an exemplary embodiment.
Figure 9B:
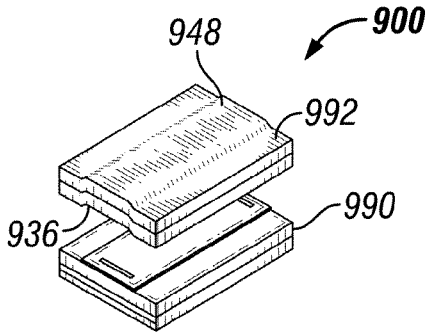
FIG. 9*b* illustrates a perspective view of the top side of the miniature power inductor as depicted in FIG. 9*a* during an intermediate manufacturing step in accordance with an exemplary embodiment.
Figure 9C:
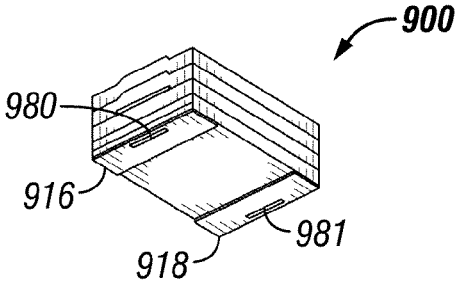
FIG. 9*c* illustrates a perspective view of the bottom side of the miniature power inductor as depicted in FIG. 9*a* in accordance with an exemplary embodiment.
Figure 9D:
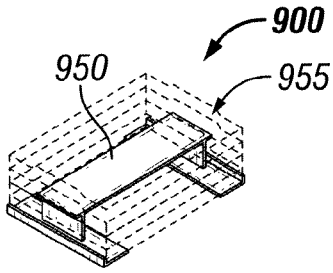
FIG. 9*d* illustrates a perspective view of the seventh winding configuration of the miniature power inductor as depicted in FIG. 9*a*, FIG. 9*b*, and FIG. 9*c* in accordance with an exemplary embodiment.

Referring to FIGS. 9*a*-9*d*, several views of a ninth illustrative embodiment of a magnetic component or device 900 are shown. FIG. 9*a* illustrates a perspective view and an exploded view of the top side of a miniature power inductor having a one turn winding in a seventh winding configuration, at least one magnetic powder sheet, and a horizontally oriented core area in accordance with an exemplary embodiment. FIG. 9*b* illustrates a perspective view of the top side of the miniature power inductor as depicted in FIG. 9*a* during an intermediate manufacturing step in accordance with an exemplary embodiment. FIG. 9*c* illustrates a perspective view of the bottom side of the miniature power inductor as depicted in FIG. 9*a* in accordance with an exemplary embodiment. FIG. 9*d* illustrates a perspective view of the seventh winding configuration of the miniature power inductor as depicted in FIG. 9*a*, FIG. 9*b*, and FIG. 9*c* in accordance with an exemplary embodiment.

According to this embodiment, the miniature power inductor 900 comprises at least one magnetic powder sheet 910, 920, 930, 940 and a winding 950 coupled to the at least one magnetic powder sheet 910, 920, 930, 940 in a seventh winding configuration 955. As seen in this embodiment, the miniature power inductor 900 comprises a first magnetic powder sheet 910 having a lower surface 912 and an upper surface 914, a second magnetic powder sheet 920 having a lower surface 922 and an upper surface 924, a third magnetic powder sheet 930 having a lower surface 932 and an upper surface 934, and a fourth magnetic powder sheet 940 having a lower surface 942 and an upper surface 944. In an exemplary embodiment, each magnetic powder sheet can be a magnetic powder sheet manufactured by Chang Sung Incorporated in Incheon, Korea and sold under product number 20u-eff Flexible Magnetic Sheet. Also, these magnetic powder sheets have grains which are dominantly oriented in a particular direction. Thus, a higher inductance may be achieved when the magnetic field is created in the direction of the dominant grain orientation. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

The first magnetic powder sheet 910 also includes a first terminal 916 and a second terminal 918 coupled to opposing longitudinal edges of the lower surface 912 of the first magnetic powder sheet 910. These terminals 916, 918 may be used to couple the miniature power inductor 900 to an electrical circuit, which may be on a printed circuit board (not shown), for example. Each of the terminals 916, 918 also comprises a via 980, 981 for coupling the terminals 916, 918 to one or more winding layers, which will be further discussed below. The vias 980, 981 are conductive connectors which proceed from the terminals 916, 918 on the lower surface 912 to the upper surface 914 of the first magnetic powder sheet 910. The vias may be folioed by drilling a hole or slot through the magnetic powder sheets and plating the inner circumference of the drilled hole or slot with conductive material. Alternatively, a conductive pin may be placed into the drilled holes to establish the conductive connections in the vias. Although the vias are shown to be rectangular in shape, the vias may be a different geometric shape, for example, circular, without departing from the scope and spirit of the exemplary embodiment. In this embodiment, a portion of the inductor is formed and pressed before drilling the vias. The remaining portion of the inductor is formed and/or pressed subsequent to forming the vias. Although the vias are shown to be formed at an intermediate manufacturing step, the vias may be formed upon complete formation of the inductor without departing from the scope and spirit of the exemplary embodiment. Although the terminals are shown to be coupled to opposing longitudinal edges, the terminals may be coupled at alternative locations on the lower surface of the first magnetic powder sheet without departing from the scope and spirit of the exemplary embodiment. Also, although each terminal is shown to have one via, additional vias may be formed in each of the terminals without departing from the scope and spirit of the exemplary embodiment.

The second magnetic powder sheet 920 has a winding layer 925 coupled to the upper surface 924 of the second magnetic powder sheet 920. The winding layer 925 is formed substantially across the center of the upper surface 924 of the second magnetic powder sheet 920 and extends from one edge to an opposing edge of the second magnetic powder sheet 920. The winding layer 925 also is oriented in a longitudinal direction such that when the first magnetic powder sheet 910 is coupled to the second magnetic powder sheet 920, the winding layer 925 is positioned substantially perpendicular to the orientation of terminals 916, 918. The winding layer 925 forms the winding 950 and is coupled to the terminal 916, 918 through the vias 980, 981. Although one winding or 1-turn is shown to be coupled to the second magnetic powder sheet in this embodiment, there may be more than one winding coupled to the second magnetic powder sheet, either in parallel or in series, depending upon the application and the requirements without departing from the scope and spirit of the exemplary embodiment. The additional windings may be coupled in series or in parallel by modifying the vias and the terminals at the lower surface of the first magnetic powder sheet and/or modifying the trace on the substrate or printed circuit board.

The winding layer 925 is formed from a conductive copper layer which is coupled to the second magnetic powder sheet 920. This conductive copper layer may include, but is not limited to, a stamped copper foil, an etched copper trace, or a preformed coil without departing from the scope and spirit of the exemplary embodiment. The etched copper trace may be formed, but is not limited to, photolithography techniques or by laser etching techniques. As shown in this embodiment, the winding layer is a rectangular-shaped linear pattern. However, other patterns may be used to form the winding without departing from the scope and spirit of the exemplary embodiment. Although copper is used as the conductive material, other conductive materials may be used without departing from the scope and spirit of the exemplary embodiment. Additionally, the terminals 916, 918 may also be formed using a stamped copper foil, an etched copper trace, or by any other suitable method.

The third magnetic powder sheet 930, according to this embodiment, may include a first indentation 936 on the lower surface 932 and a first extraction 938 on the upper surface 934 of the third magnetic powder sheet 930, wherein the first indentation 936 and the first extraction 938 extend substantially along the center of the third magnetic powder sheet 930 and from one edge to an opposing edge. The first indentation 936 and the first extraction 938 are oriented in a manner such that when the third magnetic powder sheet 930 is coupled to the second magnetic powder sheet 920, the first indentation 936 and the first extraction 938 extend in the same direction as the winding layer 925. The first indentation 936 is designed to encapsulate the winding layer 925.

The fourth magnetic powder sheet 940, according to this embodiment, may include a second indentation 946 on the lower surface 942 and a second extraction 948 on the upper surface 944 of the fourth magnetic powder sheet 940, wherein the second indentation 946 and the second extraction 948 extend substantially along the center of the fourth magnetic powder sheet 940 and from one edge to an opposing edge. The second indentation 946 and the second extraction 948 are oriented in a manner such that when the fourth magnetic powder sheet 940 is coupled to the third magnetic powder sheet 930, the second indentation 946 and the second extraction 948 extend in the same direction as the first indentation 936 and the first extraction 938. The second indentation 946 is designed to encapsulate the first extraction 938. Although this embodiment depicts an indentation and an extraction in the third and fourth magnetic powder sheets, the indentation or extraction formed in these sheets may be omitted without departing from the scope and spirit of the exemplary embodiment.

Upon forming the first magnetic powder sheet 910 and the second magnetic powder sheet 920, the first magnetic powder sheet 910 and the second magnetic powder sheet 920 are pressed together with high pressure, for example, hydraulic pressure, and laminated together to form a first portion 990 of the miniature power inductor 900. After sheets 910, 920 have been pressed together, the vias 980, 981 are formed, in accordance to the description provided above. In place of forming the vias, other terminations, including but not limited plating and etching of at least a portion of the side faces of the first portion of the miniature power inductor 900, may be made between the two sheets 910, 920 without departing from the scope and spirit of the exemplary embodiment. The third magnetic powder sheet 930 and the fourth magnetic powder sheet 940 may also be pressed together to form a second portion 992 of the miniature power inductor 900. The first and second portion 990, 992 of the miniature power inductor 900 may then be pressed together to form the completed miniature power inductor 900. According to this embodiment, the physical gap between the winding and the core, which is typically found in conventional inductors, is removed. The elimination of this physical gap tends to minimize the audible noise from the vibration of the winding.

Although there are no magnetic sheets shown between the first and second magnetic powder sheets, magnetic sheets may positioned between the first and second magnetic powder sheets so long as there remains an electrical connection between the terminals of the first and second magnetic powder sheets without departing from the scope and spirit of the exemplary embodiment. Additionally, although two magnetic powder sheets are shown to be positioned above the winding layer 925, greater or fewer sheets may be used to increase or decrease the core area without departing from the scope and spirit of the exemplary embodiment.

In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

Figure 10A:
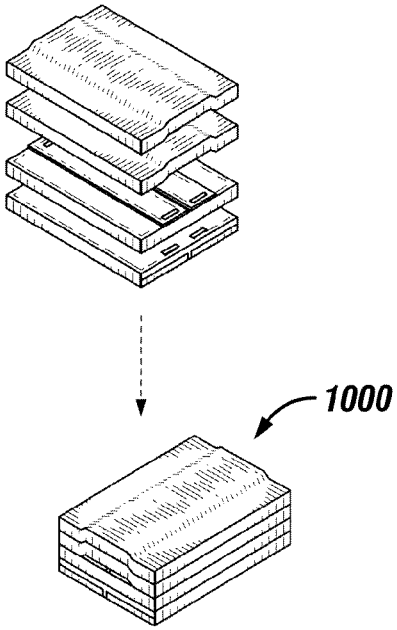
FIG. 10*a* illustrates a perspective view and an exploded view of the top side of a miniature power inductor having a two turn winding in an eighth winding configuration, at least one magnetic powder sheet, and a horizontally oriented core area in accordance with an exemplary embodiment.
Figure 10B:
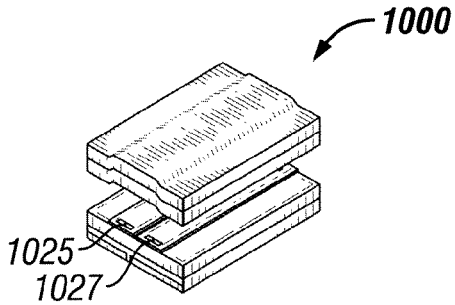
FIG. 10*b* illustrates a perspective view of the top side of the miniature power inductor as depicted in FIG. 10*a* during an intermediate manufacturing step in accordance with an exemplary embodiment.
Figure 10C:
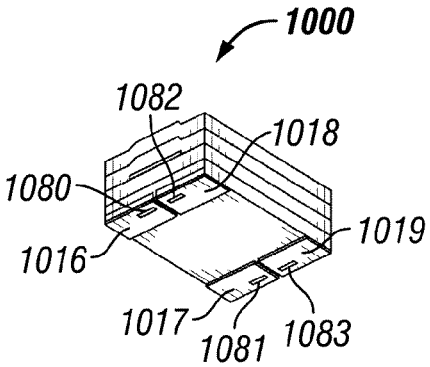
FIG. 10*c* illustrates a perspective view of the bottom side of the miniature power inductor as depicted in FIG. 10*a* in accordance with an exemplary embodiment.
Figure 10D:
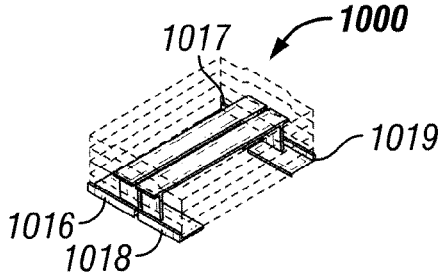
FIG. 10*d* illustrates a perspective view of the eighth winding configuration of the miniature power inductor as depicted in FIG. 10*a*, FIG. 10*b*, and FIG. 10*c* in accordance with an exemplary embodiment.

Referring to FIGS. 10*a*-10*d*, several views of a tenth illustrative embodiment of a magnetic component or device 1000 are shown. FIG. 10*a* illustrates a perspective view and an exploded view of the top side of a miniature power inductor having a two turn winding in an eighth winding configuration, at least one magnetic powder sheet, and a horizontally oriented core area in accordance with an exemplary embodiment. FIG. 10*b* illustrates a perspective view of the top side of the miniature power inductor as depicted in FIG. 10*a* during an intermediate manufacturing step in accordance with an exemplary embodiment. FIG. 10*c* illustrates a perspective view of the bottom side of the miniature power inductor as depicted in FIG. 10*a* in accordance with an exemplary embodiment. FIG. 10*d* illustrates a perspective view of the eighth winding configuration of the miniature power inductor as depicted in FIG. 10*a*, FIG. 10*b*, and FIG. 10*c* in accordance with an exemplary embodiment.

The miniature power inductor 1000 shown in FIGS. 10*a*-10*d* is similar to the miniature power inductor 900 shown in FIGS. 9*a*-9*d* except that this miniature power inductor 1000 embodies a two turn embodiment. Specifically, the first terminal 916 of the miniature power inductor 900 has been divided into two distinct terminals, thus forming a first terminal 1016 and a third terminal 1018. Additionally, the second terminal 918 of the miniature power inductor 900 has been divided into two distinct terminals, thus forming a second terminal 1017 and a fourth terminal 1019. Further, the winding layer 925 of the miniature power inductor 900 has been divided into two distinct winding layers, a first winding layer 1025 and a second winding layer 1027. The first winding layer 1025 is coupled to the first terminal 1016 and the second terminal 1017. The second winding layer 1027 is coupled to the third terminal 1018 and the fourth terminal 1019. This process may be performed by etching the first terminal 916, the second terminal 918, and the winding layer 925 of the miniature power inductor 900 through the middle of each. Also, a plurality of vias 1080, 1081, 1082, 1083 are now formed through each of the first terminal 1016, the second terminal 1017, the third terminal 1018, and the fourth terminal 1019, which results in two vias for each of the winding layers.

The manufacturing of the miniature power inductor 1000 will have most, if not all, of the flexibilities of the miniature power inductor 900, as illustrated and described with respect to FIGS. 9*a*-9*d*. Also, instead of utilizing the vias, a different method may be used to couple the windings to the terminals, including, but not limited to, metallizing the corresponding portions of the face ends of the miniature power inductor 1000.

Figure 11A:
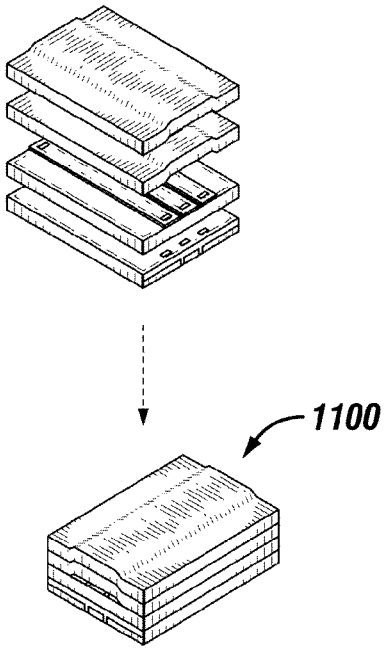
FIG. 11*a* illustrates a perspective view and an exploded view of the top side of a miniature power inductor having a three turn winding in a ninth winding configuration, at least one magnetic powder sheet, and a horizontally oriented core area in accordance with an exemplary embodiment.
Figure 11B:
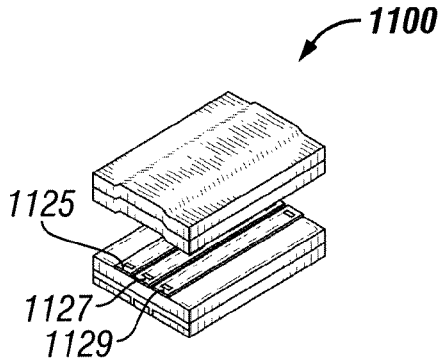
FIG. 11*b* illustrates a perspective view of the top side of the miniature power inductor as depicted in FIG. 11*a* during an intermediate manufacturing step in accordance with an exemplary embodiment.
Figure 11C:
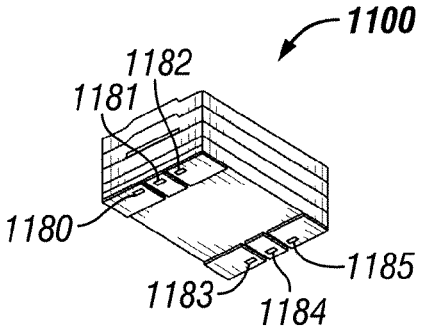
FIG. 11*c* illustrates a perspective view of the bottom side of the miniature power inductor as depicted in FIG. 11*a* in accordance with an exemplary embodiment.
Figure 11D:
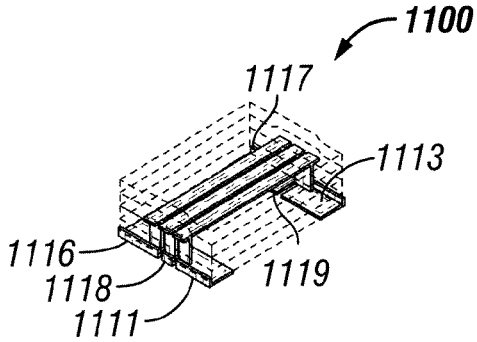
FIG. 11*d* illustrates a perspective view of the ninth winding configuration of the miniature power inductor as depicted in FIG. 11*a*, FIG. 11*b*, and FIG. 11*c* in accordance with an exemplary embodiment.

Referring to FIGS. 11*a*-11*d*, several views of an eleventh illustrative embodiment of a magnetic component or device 1100 are shown. FIG. 11*a* illustrates a perspective view and an exploded view of the top side of a miniature power inductor having a three turn winding in a ninth winding configuration, at least one magnetic powder sheet, and a horizontally oriented core area in accordance with an exemplary embodiment. FIG. 11*b* illustrates a perspective view of the top side of the miniature power inductor as depicted in FIG. 11*a* during an intermediate manufacturing step in accordance with an exemplary embodiment. FIG. 11*c* illustrates a perspective view of the bottom side of the miniature power inductor as depicted in FIG. 11*a* in accordance with an exemplary embodiment. FIG. 11*d* illustrates a perspective view of the ninth winding configuration of the miniature power inductor as depicted in FIG. 11*a*, FIG. 11*b*, and FIG. 11*c* in accordance with an exemplary embodiment.

The miniature power inductor 1100 shown in FIGS. 11*a*-11*d* is similar to the miniature power inductor 900 shown in FIGS. 9*a*-9*d* except that this miniature power inductor 1100 embodies a three turn embodiment. Specifically, the first terminal 916 of the miniature power inductor 900 has been divided into three distinct terminals, thus forming a first terminal 1116, a third terminal 1118, and a fifth terminal 1111. Additionally, the second terminal 918 of the miniature power inductor 900 has been divided into three distinct terminals, thus forming a second terminal 1117, a fourth terminal 1119, and a sixth terminal 1113. Further, the winding layer 925 of the miniature power inductor 900 has been divided into three distinct winding layers, a first winding layer 1125, a second winding layer 1127, and a third winding layer 1129. The first winding layer 1125 is coupled to the first terminal 1116 and the second terminal 1117. The second winding layer 1127 is coupled to the third terminal 1118 and the fourth terminal 1119. The third winding layer 1129 is coupled to the fifth terminal 1111 and the sixth terminal 1113. This process may be performed by etching the first terminal 916, the second terminal 918, and the winding layer 925 of the miniature power inductor 900 through into three substantially equal portions. Also, a plurality of vias 1180, 1181, 1182, 1183, 1184, 1185 are now formed through each of the first terminal 1116, the second terminal 1117, the third terminal 1118, the fourth terminal 1119, the fifth terminal 1111, and the sixth terminal 1113, which results in two vias for each of the winding layers.

The manufacturing of the miniature power inductor 1100 will have most, if not all, of the flexibilities of the miniature power inductor 900, as illustrated and described with respect to FIGS. 9*a*-9*d*. Also, instead of utilizing the vias, a different method may be used to couple the windings to the terminals, including, but not limited to, metallizing the corresponding portions of the face ends of the miniature power inductor 1100. Additionally, although a three turn embodiment is illustrated herein, greater than three turns may be formed without departing from the scope and spirit of the exemplary embodiment.

Figure 12A:
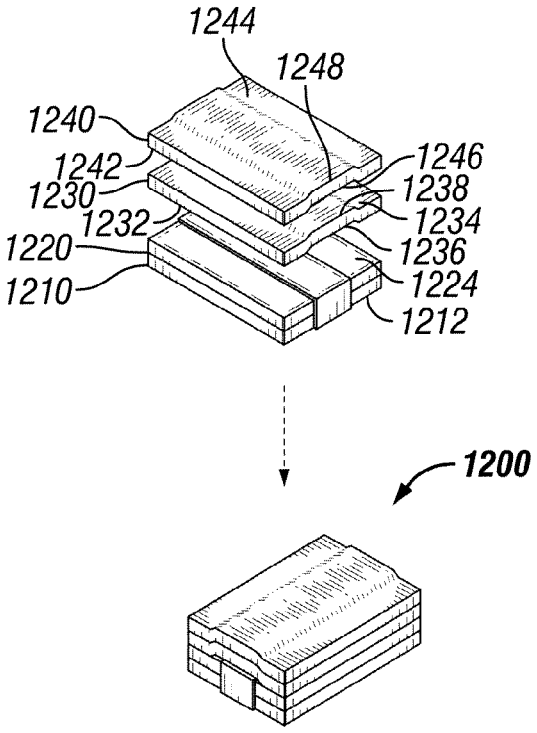
FIG. 12*a* illustrates a perspective view and an exploded view of the top side of a miniature power inductor having a one turn clip winding in a tenth winding configuration, at least one magnetic powder sheet, and a horizontally oriented core area in accordance with an exemplary embodiment.
Figure 12B:
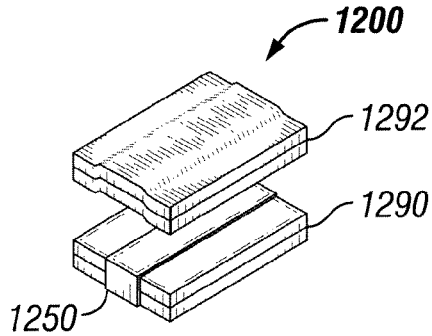
FIG. 12*b* illustrates a perspective view of the top side of the miniature power inductor as depicted in FIG. 12*a* during an intermediate manufacturing step in accordance with an exemplary embodiment.
Figure 12C:
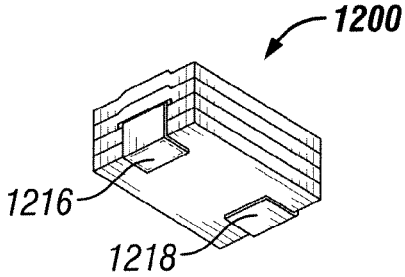
FIG. 12*c* illustrates a perspective view of the bottom side of the miniature power inductor as depicted in FIG. 12*a* in accordance with an exemplary embodiment.
Figure 12D:
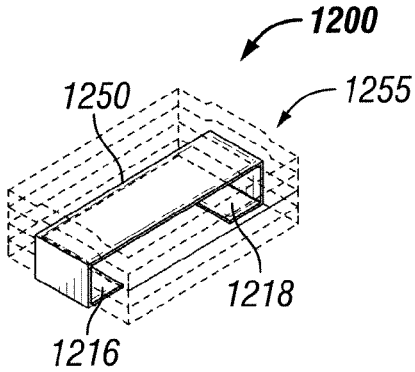
FIG. 12*d* illustrates a perspective view of the tenth winding configuration of the miniature power inductor as depicted in FIG. 12*a*, FIG. 12*b*, and FIG. 12*c* in accordance with an exemplary embodiment.

Referring to FIGS. 12*a*-12*d*, several views of a twelfth illustrative embodiment of a magnetic component or device 1200 are shown. FIG. 12*a* illustrates a perspective view and an exploded view of the top side of a miniature power inductor having a one turn clip winding in a tenth winding configuration, at least one magnetic powder sheet, and a horizontally oriented core area in accordance with an exemplary embodiment. FIG. 12*b* illustrates a perspective view of the top side of the miniature power inductor as depicted in FIG. 12*a* during an intermediate manufacturing step in accordance with an exemplary embodiment. FIG. 12*c* illustrates a perspective view of the bottom side of the miniature power inductor as depicted in FIG. 12*a* in accordance with an exemplary embodiment. FIG. 12*d* illustrates a perspective view of the tenth winding configuration of the miniature power inductor as depicted in FIG. 12*a*, FIG. 12*b*, and FIG. 12*c* in accordance with an exemplary embodiment.

According to this embodiment, the miniature power inductor 1200 comprises at least one magnetic powder sheet 1210, 1220, 1230, 1240 and a winding 1250, which may be in the form of a clip, coupled to the at least one magnetic powder sheet 1210, 1220, 1230, 1240 in a tenth winding configuration 1255. As seen in this embodiment, the miniature power inductor 1200 comprises a first magnetic powder sheet 1210 having a lower surface 1212 and an upper surface (not shown), a second magnetic powder sheet 1220 having a lower surface (not shown) and an upper surface 1224, a third magnetic powder sheet 1230 having a lower surface 1232 and an upper surface 1234, and a fourth magnetic powder sheet 1240 having a lower surface 1242 and an upper surface 1244. In an exemplary embodiment, each magnetic powder sheet can be a magnetic powder sheet manufactured by Chang Sung Incorporated in Incheon, Korea and sold under product number 20u-eff Flexible Magnetic Sheet. Also, these magnetic powder sheets have grains which are dominantly oriented in a particular direction. Thus, a higher inductance may be achieved when the magnetic field is created in the direction of the dominant grain orientation. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

The third magnetic powder sheet 1230, according to this embodiment, may include a first indentation 1236 on the lower surface 1232 and a first extraction 1238 on the upper surface 1234 of the third magnetic powder sheet 1230, wherein the first indentation 1236 and the first extraction 1238 extend substantially along the center of the third magnetic powder sheet 1230 and from one edge to an opposing edge. The first indentation 1236 and the first extraction 1238 are oriented in a manner such that when the third magnetic powder sheet 1230 is coupled to the second magnetic powder sheet 1220, the first indentation 1236 and the first extraction 1238 extend in the same direction as the winding 1250. The first indentation 1236 is designed to encapsulate the winding 1250.

The fourth magnetic powder sheet 1240, according to this embodiment, may include a second indentation 1246 on the lower surface 1242 and a second extraction 1248 on the upper surface 1244 of the fourth magnetic powder sheet 1240, wherein the second indentation 1246 and the second extraction 1248 extend substantially along the center of the fourth magnetic powder sheet 1240 and from one edge to an opposing edge. The second indentation 1246 and the second extraction 1248 are oriented in a manner such that when the fourth magnetic powder sheet 1240 is coupled to the third magnetic powder sheet 1230, the second indentation 1246 and the second extraction 1248 extend in the same direction as the first indentation 1236 and the first extraction 1238. The second indentation 1246 is designed to encapsulate the first extraction 1238. Although this embodiment depicts an indentation and an extraction in the third and fourth magnetic powder sheets, the indentation or extraction folioed in these sheets may be omitted without departing from the scope and spirit of the exemplary embodiment.

Upon forming the first magnetic powder sheet 1210 and the second magnetic powder sheet 1220, the first magnetic powder sheet 1210 and the second magnetic powder sheet 1220 are pressed together with high pressure, for example, hydraulic pressure, and laminated together to form a first portion 1290 of the miniature power inductor 1200. Also, the third magnetic powder sheet 1230 and the fourth magnetic powder sheet 1240 may also be pressed together to form a second portion 1292 of the miniature power inductor 1200. According to this embodiment, the clip 1250 is placed on the upper surface 1224 of the first portion 1290 of the miniature power inductor 1200 such that the clip extends a distance beyond both sides of the first portion 1290. This distance is equal to or greater than the height of the first portion 1290 of the miniature power inductor 1200. Once the clip 1250 is properly positioned on the upper surface 1224 of the first portion 1290, the second portion 1292 is placed on top of the first portion 1290. The first and second portions 1290, 1292 of the miniature power inductor 1200 may then be pressed together to form the completed miniature power inductor 1200. The portions of the clip 1250, which extend beyond both edges of the miniature power inductor 1200, may be bent around the first portion 1290 to form the first termination 1216 and the second termination 1218. These terminations 1216, 1218 allow the miniature power inductor 1200 to be properly coupled to a substrate or printed circuit board. According to this embodiment, the physical gap between the winding and the core, which is typically found in conventional inductors, is removed. The elimination of this physical gap tends to minimize the audible noise from the vibration of the winding.

The winding 1250 is formed from a conductive copper layer, which may be deformed to provide a desired geometry. Although a conductive copper material is used in this embodiment, any conductive material may be used without departing from the scope and spirit of the exemplary embodiment.

Although only one clip is used in this embodiment, additional clips may be used adjacent the first clip and foisted in the same manner as described for the first clip without departing from the scope and spirit of the exemplary embodiment. Although the clips may be formed parallel to one another, they may be utilized in series depending upon the trace configuration of the substrate.

Although there are no magnetic sheets shown between the first and second magnetic powder sheets, magnetic sheets may positioned between the first and second magnetic powder sheets so long as the winding is of sufficient length to adequately form the terminals for the miniature power inductor without departing from the scope and spirit of the exemplary embodiment. Additionally, although two magnetic powder sheets are shown to be positioned above the winding 1250, greater or fewer sheets may be used to increase or decrease the core area without departing from the scope and spirit of the exemplary embodiment.

In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

Figure 13A:
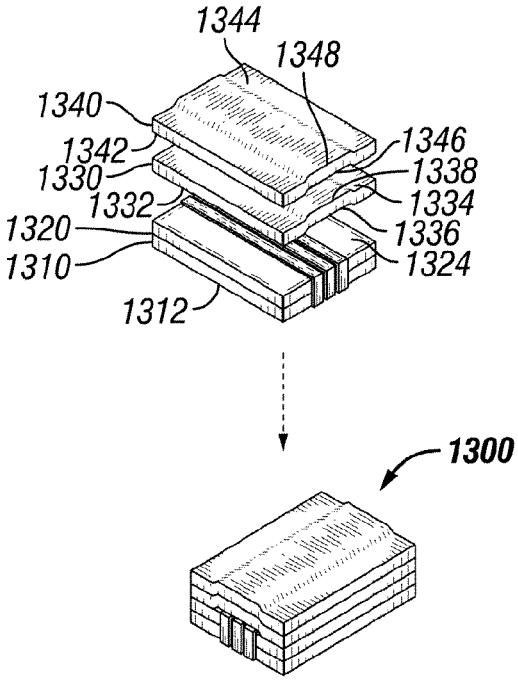
FIG. 13*a* illustrates a perspective view and an exploded view of the top side of a miniature power inductor having a three turn clip winding in an eleventh winding configuration, at least one magnetic powder sheet, and a horizontally oriented core area in accordance with an exemplary embodiment.
Figure 13B:
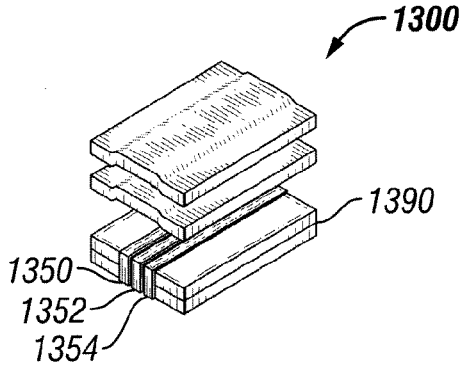
FIG. 13*b* illustrates a perspective view of the top side of the miniature power inductor as depicted in FIG. 13*a* during an intermediate manufacturing step in accordance with an exemplary embodiment.
Figure 13C:
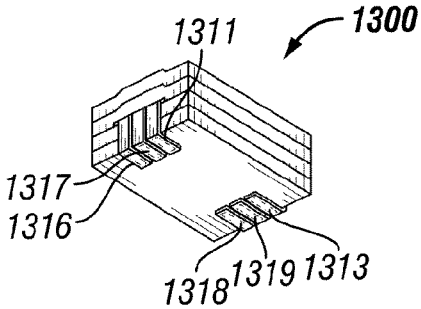
FIG. 13*c* illustrates a perspective view of the bottom side of the miniature power inductor as depicted in FIG. 13*a* in accordance with an exemplary embodiment.
Figure 13D:
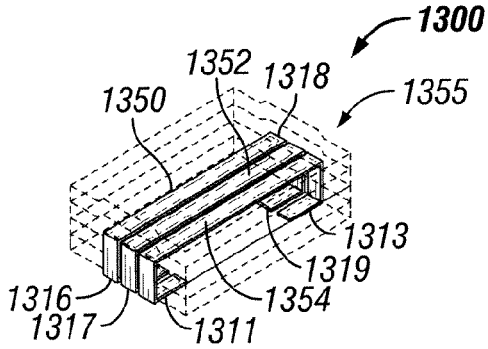
FIG. 13*d* illustrates a perspective view of the eleventh winding configuration of the miniature power inductor as depicted in FIG. 13*a*, FIG. 13*b*, and FIG. 13*c* in accordance with an exemplary embodiment.

Referring to FIGS. 13*a*-13*d*, several views of a thirteenth illustrative embodiment of a magnetic component or device 1300 are shown. FIG. 13*a* illustrates a perspective view and an exploded view of the top side of a miniature power inductor having a three turn clip winding in an eleventh winding configuration, at least one magnetic powder sheet, and a horizontally oriented core area in accordance with an exemplary embodiment. FIG. 13*b* illustrates a perspective view of the top side of the miniature power inductor as depicted in FIG. 13*a* during an intermediate manufacturing step in accordance with an exemplary embodiment. FIG. 13*c* illustrates a perspective view of the bottom side of the miniature power inductor as depicted in FIG. 13*a* in accordance with an exemplary embodiment. FIG. 13*d* illustrates a perspective view of the eleventh winding configuration of the miniature power inductor as depicted in FIG. 13*a*, FIG. 13*b*, and FIG. 13*c* in accordance with an exemplary embodiment.

According to this embodiment, the miniature power inductor 1300 comprises at least one magnetic powder sheet 1310, 1320, 1330, 1340 and a plurality of windings 1350, 1352, 1354, which each may be in the form of a clip, coupled to the at least one magnetic powder sheet 1310, 1320, 1330, 1340 in an eleventh winding configuration 1355. As seen in this embodiment, the miniature power inductor 1300 comprises a first magnetic powder sheet 1310 having a lower surface 1312 and an upper surface (not shown), a second magnetic powder sheet 1320 having a lower surface (not shown) and an upper surface 1324, a third magnetic powder sheet 1330 having a lower surface 1332 and an upper surface 1334, and a fourth magnetic powder sheet 1340 having a lower surface 1342 and an upper surface 1344. In an exemplary embodiment, each magnetic powder sheet can be a magnetic powder sheet manufactured by Chang Sung Incorporated in Incheon, Korea and sold under product number 20u-eff Flexible Magnetic Sheet. Also, these magnetic powder sheets have grains which are dominantly oriented in a particular direction. Thus, a higher inductance may be achieved when the magnetic field is created in the direction of the dominant grain orientation. Although this embodiment depicts four magnetic powder sheets, the number of magnetic sheets may be increased or reduced so as to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

The third magnetic powder sheet 1330, according to this embodiment, may include a first indentation 1336 on the lower surface 1332 and a first extraction 1338 on the upper surface 1334 of the third magnetic powder sheet 1330, wherein the first indentation 1336 and the first extraction 1338 extend substantially along the center of the third magnetic powder sheet 1330 and from one edge to an opposing edge. The first indentation 1336 and the first extraction 1338 are oriented in a manner such that when the third magnetic powder sheet 1330 is coupled to the second magnetic powder sheet 1320, the first indentation 1336 and the first extraction 1338 extend in the same direction as the plurality of windings 1350, 1352, 1354. The first indentation 1336 is designed to encapsulate the plurality of windings 1350, 1352, 1354.

The fourth magnetic powder sheet 1340, according to this embodiment, may include a second indentation 1346 on the lower surface 1342 and a second extraction 1348 on the upper surface 1344 of the fourth magnetic powder sheet 1340, wherein the second indentation 1346 and the second extraction 1348 extend substantially along the center of the fourth magnetic powder sheet 1340 and from one edge to an opposing edge. The second indentation 1346 and the second extraction 1348 are oriented in a manner such that when the fourth magnetic powder sheet 1340 is coupled to the third magnetic powder sheet 1330, the second indentation 1346 and the second extraction 1348 extend in the same direction as the first indentation 1336 and the first extraction 1338. The second indentation 1346 is designed to encapsulate the first extraction 1338. Although this embodiment depicts an indentation and an extraction in the third and fourth magnetic powder sheets, the indentation or extraction formed in these sheets may be omitted without departing from the scope and spirit of the exemplary embodiment.

Upon forming the first magnetic powder sheet 1310 and the second magnetic powder sheet 1320, the first magnetic powder sheet 1310 and the second magnetic powder sheet 1320 are pressed together with high pressure, for example, hydraulic pressure, and laminated together to foist a first portion 1390 of the miniature power inductor 1300. Also, the third magnetic powder sheet 1330 and the fourth magnetic powder sheet 1340 may also be pressed together to form a second portion (not shown) of the miniature power inductor 1300. According to this embodiment, the plurality of clips 1350, 1352, 1354 are placed on the upper surface 1324 of the first portion 1390 of the miniature power inductor 1300 such that the plurality of clips extend a distance beyond both sides of the first portion 1390. This distance is equal to or greater than the height of the first portion 1390 of the miniature power inductor 1300. Once the plurality of clips 1350, 1352, 1354 are properly positioned on the upper surface 1324 of the first portion 1390, the second portion (not shown) is placed on top of the first portion 1390. The first and second portions 1390, (not shown) of the miniature power inductor 1300 may then be pressed together to form the completed miniature power inductor 1300. The portions of the plurality of clips 1350, 1352, 1354, which extend beyond both edges of the miniature power inductor 1300, may be bent around the first portion 1390 to form the first termination 1316, the second termination 1318, the third termination 1317, the fourth termination 1319, the fifth termination 1311, and the sixth termination 1313. These terminations 1311, 1313, 1316, 1317, 1318, 1319 allow the miniature power inductor 1300 to be properly coupled to a substrate or printed circuit board. According to this embodiment, the physical gap between the winding and the core, which is typically found in conventional inductors, is removed. The elimination of this physical gap tends to minimize the audible noise from the vibration of the winding.

The plurality of windings 1350, 1352, 1354 is formed from a conductive copper layer, which may be deformed to provide a desired geometry. Although a conductive copper material is used in this embodiment, any conductive material may be used without departing from the scope and spirit of the exemplary embodiment.

Although only three clips are shown in this embodiment, greater or fewer clips may be used without departing from the scope and spirit of the exemplary embodiment. Although the clips are shown in a parallel configuration, the clips may be used in series depending upon the trace configuration of the substrate.

Although there are no magnetic sheets shown between the first and second magnetic powder sheets, magnetic sheets may positioned between the first and second magnetic powder sheets so long as the winding is of sufficient length to adequately form the terminals for the miniature power inductor without departing from the scope and spirit of the exemplary embodiment. Additionally, although two magnetic powder sheets are shown to be positioned above the plurality of windings 1350, 1352, 1354, greater or fewer sheets may be used to increase or decrease the core area without departing from the scope and spirit of the exemplary embodiment.

In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

Figure 14A:
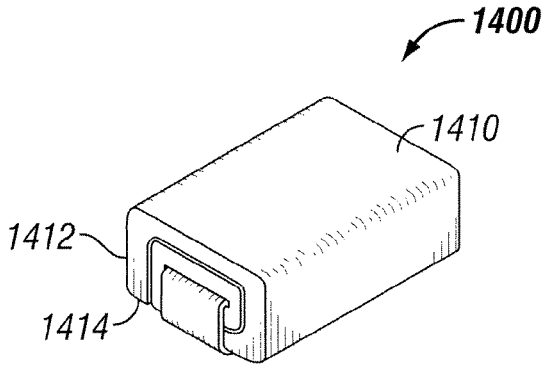
FIG. 14*a* illustrates a perspective view of the top side of a miniature power inductor having a one turn clip winding in a twelfth winding configuration, a rolled magnetic powder sheet, and a horizontally oriented core area in accordance with an exemplary embodiment.
Figure 14B:
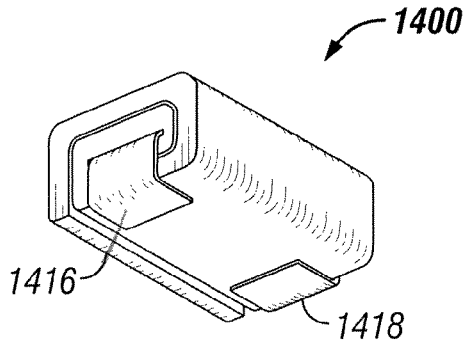
FIG. 14*b* illustrates a perspective view of the bottom side of the miniature power inductor as depicted in FIG. 14*a* in accordance with an exemplary embodiment.
Figure 14C:
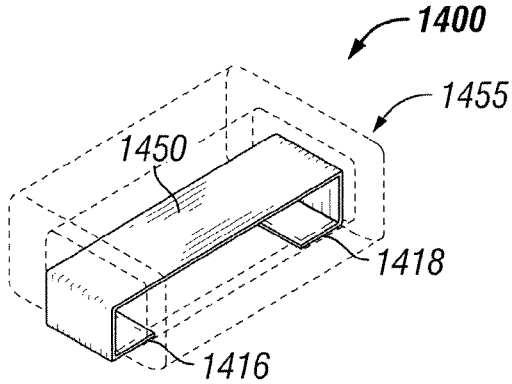
FIG. 14*c* illustrates a perspective view of the twelfth winding configuration of the miniature power inductor as depicted in FIG. 14*a* and FIG. 14*b* in accordance with an exemplary embodiment.

Referring to FIGS. 14*a*-14*c*, several views of a fourteenth illustrative embodiment of a magnetic component or device 1400 are shown. FIG. 14*a* illustrates a perspective view of the top side of a miniature power inductor having a one turn clip winding in a twelfth winding configuration, a rolled magnetic powder sheet, and a horizontally oriented core area in accordance with an exemplary embodiment. FIG. 14*b* illustrates a perspective view of the bottom side of the miniature power inductor as depicted in FIG. 14*a* in accordance with an exemplary embodiment. FIG. 14*c* illustrates a perspective view of the twelfth winding configuration of the miniature power inductor as depicted in FIG. 14*a* and FIG. 14*b* in accordance with an exemplary embodiment.

According to this embodiment, the miniature power inductor 1400 comprises a rolled magnetic powder sheet 1410 and a winding 1450, which may be in the form of a clip, coupled to the rolled magnetic powder sheet 1410 in a twelfth winding configuration 1455. As seen in this embodiment, the miniature power inductor 1400 comprises a first magnetic powder sheet 1410 having a lower surface 1412 and an upper surface 1414. In an exemplary embodiment, each magnetic powder sheet can be a magnetic powder sheet manufactured by Chang Sung Incorporated in Incheon, Korea and sold under product number 20u-eff Flexible Magnetic Sheet. Also, these magnetic powder sheets have grains which are dominantly oriented in a particular direction. Thus, a higher inductance may be achieved when the magnetic field is created in the direction of the dominant grain orientation. Although this embodiment depicts a magnetic powder sheet with a desired length, the desired length may be increased or reduced so as to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

Upon forming the first magnetic powder sheet 1410, the clip 1450 is placed on the upper surface 1414 of the first magnetic powder sheet 1410 such that the clip 1410 extends a distance beyond both sides of the first magnetic powder sheet 1410 and one edge of the clip 1450 is aligned with an edge of the first magnetic powder sheet 1410. The distance is equal to or greater than the distance from where the clip 1450 extends beyond both sides of the first magnetic powder sheet 1410 to the bottom surface 1490 of the miniature power inductor 1400. Once the clip 1450 is properly positioned on the upper surface 1414 of the first magnetic powder sheet 1410, the clip 1450 and the first magnetic powder sheet 1410 are rolled over each other to form the structure of the miniature power inductor 1400. The structure of the miniature power inductor 1400 is then pressed together with high pressure, for example, hydraulic pressure, and laminated together to form the miniature power inductor 1400. Finally, the portions of the clip 1450, which extend beyond both edges of the miniature power inductor 1400, may be bent around the bottom surface 1490 of the miniature power inductor 1400 to form the first termination 1416 and the second termination 1418. These terminations 1416, 1418 allow the miniature power inductor 1400 to be properly coupled to a substrate or printed circuit board. According to this embodiment, the physical gap between the winding and the core, which is typically found in conventional inductors, is removed. The elimination of this physical gap tends to minimize the audible noise from the vibration of the winding.

The winding 1450 is formed from a conductive copper layer, which may be deformed to provide a desired geometry. Although a conductive copper material is used in this embodiment, any conductive material may be used without departing from the scope and spirit of the exemplary embodiment.

Although only one clip is used in this embodiment, additional clips may be used adjacent the first clip and formed in the same manner as described for the first clip without departing from the scope and spirit of the exemplary embodiment. Although the clips may be formed parallel to one another, they may be utilized in series depending upon the trace configuration of the substrate.

In this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

Although several embodiments have been disclosed above, it is contemplated that the invention includes modifications made to one embodiment based upon the teachings of the remaining embodiments.

Although the invention has been described with reference to specific embodiments, these descriptions are not meant to be construed in a limiting sense. Various modifications of the disclosed embodiments, as well as alternative embodiments of the invention will become apparent to persons having ordinary skill in the art upon reference to the description of the invention. It should be appreciated by those having ordinary skill in the art that the conception and the specific embodiments disclosed may be readily utilized as a basis for modifying or designing other structures for carrying out the same purposes of the invention. It should also be realized by those having ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A method of manufacturing an electromagnetic component, the method comprising:

providing a plurality of substantially planar and flexible magnetic powder sheets, wherein each of the plurality of substantially planar and flexible magnetic powder sheets is capable of being laminated to another one of the plurality of substantially planar and flexible magnetic powder sheets;

providing at least one preformed multiple turn conductive winding including a flexible wire conductor that is wound in multiple turns about an open center area and further including first and second leads, wherein the at least one preformed multiple turn conductive winding is separately fabricated from all of the plurality of substantially planar and flexible magnetic powder sheets;

stacking the plurality of substantially planar and flexible magnetic powder sheets;

locating the at least one preformed multiple turn conductive winding between at least two of the plurality of substantially planar and flexible magnetic powder sheets in the stack;

pressure laminating the substantially planar and flexible magnetic powder sheets around the at least one preformed multiple turn conductive winding to define a magnetic core containing the at least one preformed multiple turn conductive winding, wherein at least one of the plurality of substantially planar and flexible magnetic powder sheets is pressed directly to and around the at least one preformed multiple turn conductive winding, and wherein at least two of the plurality of substantially planar and flexible magnetic powder sheets are disposed adjacent to the at least one preformed multiple turn conductive winding without a physical gap being formed adjacent the at least one preformed multiple turn conductive winding;

providing first and second terminals on at least one of the plurality of substantially planar and flexible magnetic powder sheets; and connecting the first and second terminals to the respective first and second leads.

2. The method of claim 1, wherein providing the first and second terminals on at least one of the plurality of substantially planar and flexible magnetic powder sheets comprises forming first and second terminals on a surface of one of the plurality of substantially planar and flexible magnetic powder sheets.

3. The method of claim 1, wherein connecting the first and second terminals to the respective first and second leads comprises providing surface mount terminals on the magnetic core.

4. The method of claim 1, wherein providing the plurality of substantially planar and flexible magnetic powder sheets comprises providing a plurality of substantially planar and flexible magnetic powder sheets including magnetic powder material mixed with a thermoplastic resin, and wherein stacking the plurality of substantially planar and flexible magnetic powder sheets comprises stacking the plurality of substantially planar and flexible magnetic powder sheets in a solidified state.

5. The method of claim 1, wherein the electromagnetic component is a miniature power inductor and wherein providing the at least one preformed multiple turn conductive winding comprises selecting the number of turns in the at least one preformed multiple turn conductive winding to provide a predetermined inductance.

6. The method of claim 1, wherein pressure laminating the plurality of substantially planar and flexible magnetic powder sheets further comprises:

pressure laminating first and second flexible ones of the plurality of substantially planar and flexible magnetic powder sheets to one another form a first subassembly;

pressure laminating third and fourth flexible ones of the substantially planar and flexible magnetic powder sheets to one another to form a second subassembly; and pressure laminating the first and second subassemblies around the at least one preformed multiple turn conductive winding.

7. The method of claim 1, wherein providing the at least one preformed multiple turn conductive winding comprises winding an elongated, freestanding and flexible wire conductor into the at least one preformed multiple turn conductive winding.

8. The method of claim 1, wherein providing first and second terminals on at least one of the plurality of substantially planar and flexible magnetic powder sheets comprises:

providing a first terminal on a first one of the plurality of substantially planar and flexible magnetic powder sheets;

providing a second terminal on a second one of the plurality of substantially planar and flexible magnetic powder sheets; and connecting the first and second terminals with a plurality of vias.

9. The method of claim 1, wherein providing first and second terminals on at least one of the plurality of substantially planar and flexible magnetic powder sheets comprises:

extending a first terminal for an entire length of a first one of the plurality of substantially planar and flexible magnetic powder sheets; and wherein connecting the first and second terminals to the respective first and second leads comprises connecting the at least one preformed multiple turn coil to the first terminal.

10. The method of claim 1, wherein all of the plurality of substantially planar and flexible magnetic powder sheets include magnetic metal powders mixed with a thermoplastic resin.

11. The method of claim 1, wherein providing the at least one preformed multiple turn conductive winding comprises concentrically winding a plurality of turns of the flexible wire conductor.

12. The method of claim 1, wherein providing the at least one preformed multiple turn conductive winding comprises defining a curvilinear spiral path with a plurality of turns of the flexible wire conductor.

13. The method of claim 1, wherein providing the at least one preformed multiple turn conductive winding comprises winding the flexible wire conductor into a plurality of substantially coplanar turns.

14. The method of claim 1, wherein providing the at least one preformed multiple turn conductive winding comprises providing a single preformed multiple turn conductive winding, whereby the pressure laminated plurality of substantially planar and flexible magnetic powder sheets define the magnetic core containing only the single conductive preformed multiple turn winding.

15. The method of claim 1, wherein the at least two of the pressure laminated flexible magnetic powder sheets are laminated in surface contact with one another in the open center area.

16. The method of claim 1, wherein locating the at least one preformed multiple turn conductive winding between the at least two of the plurality of substantially planar and flexible magnetic powder sheets in the stack comprises extending the at least one preformed multiple turn conductive winding entirely between a first one of the plurality of substantially planar and flexible magnetic powder sheets and a second one of the plurality of substantially planar and flexible magnetic powder sheets.

17. A method of manufacturing an electromagnetic component including:

a magnetic core defined by a plurality of substantially planar and flexible magnetic powder sheets, wherein each of the plurality of substantially planar and flexible magnetic powder sheets is capable of being laminated to another one of the plurality of substantially planar and flexible magnetic powder sheets, wherein first and second terminals are provided on at least one of the plurality of substantially planar and flexible magnetic powder sheets; and at least one preformed multiple turn conductive winding including a flexible wire conductor that is wound in multiple turns about an open center area and that includes first and second leads, wherein the at least one preformed multiple turn conductive winding is separately fabricated from all of the plurality of substantially planar and flexible magnetic powder sheets;

wherein the method comprises:

stacking the plurality of substantially planar and flexible magnetic powder sheets;

locating the at least one preformed multiple turn conductive winding between at least two of the plurality of substantially planar and flexible magnetic powder sheets in the stack;

pressure laminating the plurality of substantially planar and flexible magnetic powder sheets around the at least one preformed multiple turn conductive winding to define the magnetic core, wherein at least one of the plurality of substantially planar and flexible magnetic powder sheets is pressed directly to and around the at least one preformed multiple turn conductive winding, and wherein at least two of the plurality of substantially planar and flexible magnetic powder sheets are disposed adjacent to the at least one preformed multiple turn conductive winding without a physical gap being formed adjacent the at least one preformed multiple turn conductive winding; and connecting the first and second terminals to the respective first and second leads.

18. The method of claim 17, wherein the at least one preformed multiple turn conductive winding includes first and second leads, wherein first and second terminals are provided on a surface of one of the flexible magnetic powder sheets and wherein the method further comprises connecting the first and second leads to the respective first and second terminals.

19. The method of claim 17, wherein the at least one preformed multiple turn conductive winding includes first and second leads, and the method further comprises defining first and second surface mount terminals on the magnetic core, wherein the first and second surface mount terminals are electrically connected to the respective first and second surface mount terminals.

20. The method of claim 17, wherein each of the plurality of substantially planar and flexible magnetic powder sheets includes magnetic powder material mixed with a thermoplastic resin, and wherein stacking the plurality of substantially planar and flexible magnetic powder sheets comprises stacking the plurality of substantially planar and flexible magnetic powder sheets in a solidified state.

21. The method of claim 17, wherein the electromagnetic component is a miniature power inductor and wherein locating the at least one preformed multiple turn conductive winding comprises locating a conductive winding having a number or turns to provide a predetermined inductance for the power inductor.

22. The method of claim 17, wherein pressure laminating the plurality of substantially planar and flexible magnetic powder sheets further comprises:

pressure laminating first and second ones of the plurality of substantially planar and flexible magnetic powder sheets to one another form a first subassembly;

pressure laminating third and fourth ones of the plurality of substantially planar and flexible magnetic powder sheets to one another to form a second subassembly; and pressure laminating the first and second subassemblies around the at least one preformed multiple turn conductive winding.

23. The method of claim 17, wherein the at least one preformed multiple turn conductive winding is freestanding.

24. The method of claim 17, further comprising:

providing a first terminal on a first one of the plurality of substantially planar and flexible magnetic powder sheets;

providing a second terminal on a second one of the plurality of substantially planar and flexible magnetic powder sheets; and connecting the first and second terminals with a plurality of vias.

25. The method of claim 17, further comprising: providing a first terminal on a first one of the plurality of substantially planar and flexible magnetic powder sheets so that the first terminal extends an entire length of the first one of the plurality of substantially planar and flexible magnetic powder sheets, and the method further comprises connecting the at least one preformed multiple turn coil to the first terminal.

26. The method of claim 17, wherein all of the plurality of substantially planar and flexible magnetic powder sheets include magnetic metal powders mixed with a thermoplastic resin.

27. The method of claim 17 wherein locating the at least one preformed multiple turn conductive winding comprises locating a winding having a plurality of turns that are concentrically wound.

28. The method of claim 17, wherein locating the at least one preformed multiple turn conductive winding comprises locating a winding having a plurality of turns defining a curvilinear spiral path of a conductor.

29. The method of claim 17, wherein locating the at least one preformed multiple turn conductive winding comprises locating a winding having a plurality of substantially coplanar turns.

30. The method of claim 17, wherein locating the at least one preformed multiple turn conductive winding locating a single conductive winding, whereby the pressure laminated plurality of substantially planar and flexible magnetic powder sheets define the magnetic core containing only the single conductive winding.

31. The method of claim 17, wherein pressure laminating the plurality of substantially planar and flexible magnetic powder sheets around the at least one preformed multiple turn conductive winding comprises pressure laminating at least two of the plurality of substantially planar and flexible magnetic powder sheets in surface contact with one another in the open center area.

32. The method of claim 17, wherein locating the at least one preformed multiple turn conductive winding between at least two of the plurality of substantially planar and flexible magnetic powder sheets in the stack comprises extending the at least one preformed multiple turn conductive winding entirely between a first one of the plurality of substantially planar and flexible magnetic powder sheets and a second one of the plurality of substantially planar and flexible magnetic powder sheets.

33. A method of manufacturing an electromagnetic component including:

a magnetic core defined by a plurality of substantially planar and flexible magnetic powder sheets, wherein each of the plurality of substantially planar and flexible magnetic powder sheets is capable of being laminated to another one of the plurality of substantially planar and flexible magnetic powder sheets when the plurality of substantially planar and flexible magnetic powder sheets are arranged in a stack, and wherein first and second terminals are provided on one of the first and second ones of the plurality of substantially planar and flexible magnetic powder sheets; and at least one preformed multiple turn conductive winding having multiple turns extending about an open center area, wherein the at least one preformed multiple turn conductive winding is separately fabricated from all of the plurality of substantially planar and flexible magnetic powder sheets, wherein the at least one preformed multiple turn conductive winding is fabricated from a flexible wire conductor having first and second leads;

wherein the method comprises:

locating the at least one preformed multiple turn conductive winding between first and second ones of the plurality of substantially planar and flexible magnetic powder sheets;

pressure laminating the plurality of substantially planar and flexible magnetic powder sheets around the at least one preformed multiple turn conductive winding to define the magnetic core, wherein the first and second ones of the plurality of substantially planar and flexible magnetic powder sheets is are pressed directly to and around the at least one preformed multiple turn conductive winding, and wherein at least first and second ones of the plurality of substantially planar and flexible magnetic powder sheets are disposed adjacent to the at least one preformed multiple turn conductive winding without a physical gap being formed adjacent the at least one preformed multiple turn conductive winding;

completing first and second surface mount terminals respectively connected to the first and second leads of the at least one preformed multiple turn conductive winding; and connecting the first and second terminals to the respective first and second leads.

34. The method of claim 33, wherein the first and second surface mount terminals are provided on a surface of a third one of the plurality of substantially planar and flexible magnetic powder sheets and wherein the method further comprises connecting the first and second leads to the respective first and second surface mount terminals.

35. The method of claim 33, wherein completing first and second surface mount terminals respectively connected to the first and second leads of the at least one preformed multiple turn conductive winding comprises establishing conductive vias between the first and second leads to the respective first and second surface mount terminals.

36. The method of claim 33, wherein each of the plurality of substantially planar and flexible magnetic powder sheets includes magnetic powder material mixed with a thermoplastic resin, and wherein stacking the plurality of substantially planar and flexible magnetic powder sheets comprises stacking the plurality of substantially planar and flexible magnetic powder sheets in a solidified state.

37. The method of claim 33, wherein the electromagnetic component is a miniature power inductor and wherein locating the at least one preformed multiple turn conductive winding comprises locating a conductive winding having a number or turns to provide a predetermined inductance for the miniature power inductor.

38. The method of claim 33, wherein pressure laminating the plurality of substantially planar and flexible magnetic powder sheets further comprises:

pressure laminating the first one of the plurality of substantially planar and flexible magnetic powder sheets to a third one of the plurality of substantially planar and flexible magnetic powder sheets to form a first subassembly;

pressure laminating the second one of the plurality of substantially planar and flexible magnetic powder sheets to a fourth one of the plurality of substantially planar and flexible magnetic powder sheets to form a second subassembly; and pressure laminating the first and second subassemblies around the at least one preformed multiple turn conductive winding.

39. The method of claim 33, wherein locating the at least one preformed multiple turn conductive winding comprises locating an elongated, freestanding and flexible wire conductor that is wound into the at least one preformed multiple turn conductive winding.

40. The method of claim 33, further comprising providing a first terminal on the first one of the plurality of substantially planar and flexible magnetic powder sheets, providing a second terminal on a third one of the plurality of substantially planar and flexible magnetic powder sheets, and connecting the first and second terminals.

41. The method of claim 33, further comprising providing a first terminal on the first one of the plurality of substantially planar and flexible magnetic powder sheets so that the first terminal extends an entire length of the first one of the plurality of substantially planar and flexible magnetic powder sheets, and connecting one of the first and second leads of the preformed multiple turn coil to the first terminal.

42. The method of claim 33, wherein all of the plurality of substantially planar and flexible magnetic powder sheets include magnetic metal powders mixed with a thermoplastic resin.

43. The method of claim 33 wherein locating the at least one preformed multiple turn conductive winding comprises locating a winding having a plurality of turns that are concentrically wound.

44. The method of claim 33, wherein locating the at least one preformed multiple turn conductive winding comprises locating a winding having a plurality of turns defining a curvilinear spiral path of a conductor.

45. The method of claim 33, wherein locating the at least one preformed multiple turn conductive winding comprises locating a winding having a plurality of substantially coplanar turns.

46. The method of claim 33, wherein locating the at least one preformed multiple turn conductive winding comprises locating a single conductive winding, whereby the pressure laminated plurality of substantially planar and flexible magnetic powder sheets define the magnetic core containing only the single conductive winding.

47. The method of claim 33, wherein pressure laminating the plurality of substantially planar and flexible magnetic powder sheets around the at least one preformed multiple turn conductive winding comprises pressure laminating the first and second ones of the plurality of substantially planar and flexible magnetic powder sheets in surface contact with one another in the open center area.

48. The method of claim 33, wherein locating the at least one preformed multiple turn conductive winding between the first and second ones of the plurality of substantially planar and flexible magnetic powder sheets in the stack comprises extending the at least one preformed multiple turn conductive winding entirely between the first one of the plurality of substantially planar and flexible magnetic powder sheets and the second one of the plurality of substantially planar and flexible magnetic powder sheets.

* * * * *